US009961755B2

(12) United States Patent
Umeda et al.

(10) Patent No.: US 9,961,755 B2
(45) Date of Patent: May 1, 2018

(54) EXTREME ULTRAVIOLET LIGHT GENERATION DEVICE

(71) Applicant: Gigaphoton Inc., Tochigi (JP)

(72) Inventors: Hiroshi Umeda, Oyama (JP); Kazukiyo Kamikanna, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days. days.

(21) Appl. No.: 15/498,902

(22) Filed: Apr. 27, 2017

(65) Prior Publication Data

US 2017/0231075 A1 Aug. 10, 2017

Related U.S. Application Data

(63) Continuation of application No. PCT/JP2014/084540, filed on Dec. 26, 2014.

(51) Int. Cl.
*H05G 2/00* (2006.01)

(52) U.S. Cl.
CPC ..... *H05G 2/006* (2013.01); *H05G 2/005* (2013.01); *H05G 2/008* (2013.01)

(58) Field of Classification Search
CPC ..... H05G 2/005; H05G 2/006; H05G 2/008
See application file for complete search history.

(56) References Cited

U.S. PATENT DOCUMENTS 6,186,192 B1 2/2001 Orme-Marmarelis et al.
7,405,416 B2 7/2008 Algots et al.
7,838,854 B2 11/2010 Algots et al.
9,125,285 B2 * 9/2015 Umeda ..... H05G 2/008
(Continued)

FOREIGN PATENT DOCUMENTS

JP 2010-080940 A 4/2010
JP 2012-099451 A 5/2012
(Continued)

OTHER PUBLICATIONS

The International Preliminary Report on Patentability (Chapter I) and Translation of Written Opinion of the International Searching Authority; PCT/JP2014/084540; dated Jun. 27, 2017.
(Continued)

*Primary Examiner* — Eliza Osenbaugh-Stewar
(74) *Attorney, Agent, or Firm* — Studebaker & Brackett PC

(57) ABSTRACT

An extreme ultraviolet light generation device may include: a chamber earthed to a ground, in which extreme ultraviolet light is generated by irradiating a metal target supplied inside with laser light; a target supply unit earthed to the ground and configured to output the target supplied into the chamber from a nozzle; an extraction electrode configured to exert electrostatic force on the target by applying a negative first potential to the extraction electrode; a first power supply configured to apply the first potential to the extraction electrode; an acceleration electrode unit configured to accelerate the target by applying a negative second potential lower than the first potential to the acceleration electrode unit; a second power supply configured to apply the second potential to the acceleration electrode unit; and a charge neutralizer disposed inside the acceleration electrode unit and configured to emit electrons onto the target.

4 Claims, 7 Drawing Sheets

(56) References Cited

U.S. PATENT DOCUMENTS

| | | | | |
|---|---|---|---|---|
| 2007/0228301 | A1* | 10/2007 | Nakano | H01J 49/027 250/504 R |
| 2010/0284774 | A1 | 11/2010 | Swallow et al. | |
| 2011/0101863 | A1* | 5/2011 | Komori | G03F 7/70033 315/111.41 |
| 2012/0085922 | A1* | 4/2012 | Yabu | H05G 2/008 250/432 R |
| 2012/0241650 | A1* | 9/2012 | Yabu | H05G 2/003 250/504 R |
| 2013/0186567 | A1 | 7/2013 | Yanagida et al. | |
| 2014/0061512 | A1 | 3/2014 | Umeda | |
| 2014/0138560 | A1 | 5/2014 | Umeda et al. | |
| 2014/0209819 | A1 | 7/2014 | Umeda | |

FOREIGN PATENT DOCUMENTS

| | | | |
|---|---|---|---|
| JP | 2012-216586 | A | 11/2012 |
| JP | 2013-152845 | A | 8/2013 |
| JP | 2014-049233 | A | 3/2014 |
| JP | 2014-102981 | A | 6/2014 |
| JP | 2014-143150 | A | 8/2014 |

OTHER PUBLICATIONS

International Search Report issued in PCT/JP2014/084540; dated Apr. 7, 2015.

* cited by examiner

EXTREME ULTRAVIOLET LIGHT GENERATION DEVICE

CROSS-REFERENCE TO RELATED APPLICATIONS

The present application is a continuation application of International Application No. PCT/JP2014/084540 filed on Dec. 26, 2014. The content of the application is incorporated herein by reference in its entirety.

BACKGROUND

1. Technical Field

The present disclosure relates to an extreme ultraviolet light generation device.

2. Related Art

In recent years, as semiconductor processes have moved to finer design rules, transfer patterns for photolithography in semiconductor processes have been shifted to finer designs. In the next generation, fine patterning of 70 nm to 45 nm or fine patterning of 32 nm or less will be required. To meet the requirement for fine patterning of 32 nm or less, for example, the development of a stepper has been expected which is an extreme ultraviolet (EUV) light generation device for generating extreme ultraviolet (EUV) light with approximately 13 nm of wavelength combined with reduced projection reflective optics.

The following three devices have been proposed as EUV light generation devices: a laser produced plasma (LPP: laser excited plasma) device which uses plasma generated by irradiation of a target with laser light, a discharge produced plasma (DPP) device which uses plasma generated by discharge, and a synchrotron radiation (SR) device which uses synchrotron orbital radiation.

CITATION LIST

Patent Literature

Patent Literature 1: Japanese Patent Application Laid-Open No. 2014-143150

Patent Literature 2: Japanese Patent Application Laid-Open No. 2012-099451

Patent Literature 3: Japanese Patent Application Laid-Open No. 2010-080940

Patent Literature 4: Japanese Patent Application Laid-Open No. 2012-216586

Patent Literature 5: U.S. Pat. No. 6,186,192

Patent Literature 6: U.S. Pat. No. 7,405,416

Patent Literature 7: U.S. Patent Application Publication No. 2010/0284774

Patent Literature 8: U.S. Pat. No. 7,838,854

SUMMARY

An extreme ultraviolet light generation device according to an aspect of the present disclosure may include a chamber, a target supply unit, an extraction electrode, a first power supply, an acceleration electrode unit, a second power supply and a charge neutralizer. The chamber may be earthed to a ground, in which extreme ultraviolet light is generated by irradiating a metal target supplied inside with laser light. The target supply unit may be earthed to the ground, fixed to the chamber and configured to output the target to be supplied into the chamber from a nozzle. The extraction electrode may be disposed on a target output side of the nozzle and configured to exert electrostatic force on the target by applying a negative first potential to the extraction electrode. The first power supply may be configured to apply the first potential to the extraction electrode. The acceleration electrode unit may be disposed at a position through which the target extracted by the extraction electrode passes, and configured to accelerate the target by applying a negative second potential lower than the first potential to the acceleration electrode unit. The second power supply may be configured to apply the second potential to the acceleration electrode unit. The charge neutralizer may be disposed inside the acceleration electrode unit and configured to emit electrons onto the target.

BRIEF DESCRIPTION OF THE DRAWINGS

Embodiments of the present disclosure will be hereafter described, only by way of example, with reference to the accompanying drawings.

EMBODIMENTS

—Contents—

Figure 1:
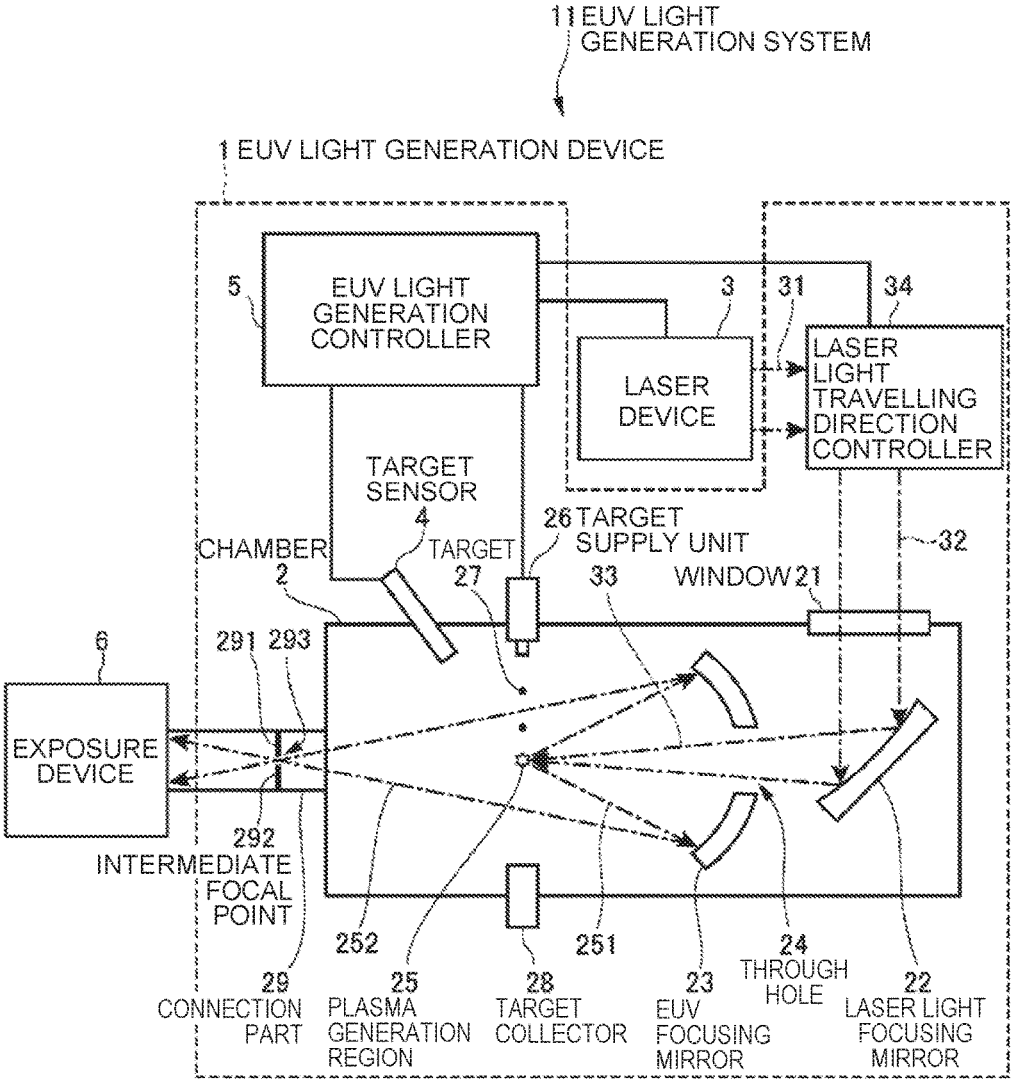
FIG. 1 schematically illustrates a configuration of an exemplary LPP EUV light generation system.

1. Overview
2. Terms
3. Overall Description of EUV Light Generation System
3.1 Configuration
3.2 Operation
4. EUV Light Generation Device Including Charge Neutralizer
4.1 Configuration
4.2 Operation
5. Problem
6. Target Generation Device Included in EUV Light Generation Device of First Embodiment
6.1 Configuration
6.2 Operation
6.3 Effect
7. Target Generation Device Included in EUV Light Generation Device of Second Embodiment
8. Miscellaneous
8.1 Hardware Environment for Controllers
8.2 Other Modifications Hereafter, embodiments of the present disclosure are described in detail with reference to the drawings. The embodiments described below are to be taken merely as examples of the present disclosure and do not limit the scope of the present disclosure. In addition, the entirety of the configuration and the operation described for each embodiment is not necessarily essential to the configuration and the operation of the present disclosure. It should be noted that the same constituents are given the same reference numerals and their duplicated description is omitted.

1. Overview

The present disclosure can at least disclose the following embodiments merely by way of example.

An EUV light generation device 1 of the present disclosure may include: a chamber 2 earthed to a ground, in which EUV light 252 is generated by irradiating a metal target 27 supplied inside with pulse laser light 33; a target supply unit 26 earthed to the ground, that is fixed to the chamber 2 and configured to output the target 27 supplied into the chamber 2 from a nozzle 262; an extraction electrode 752 that is disposed on a side, of the nozzle 262, of outputting the target 27 and configured to exert electrostatic force on the target 27 by applying a negative first potential P1 to the extraction electrode 752; a first power supply 755 that is configured to apply the first potential P1 to the extraction electrode 752; an acceleration electrode unit 753 that is disposed at a position through which the target 27 extracted by the extraction electrode 752 passes, and configured to accelerate the target 27 by applying a negative second potential P2 lower than the first potential P1 to the acceleration electrode unit 753; a second power supply 756 that is configured to apply the second potential P2 to the acceleration electrode unit 753; and a charge neutralizer 754 that is disposed inside the acceleration electrode unit 753 and configured to emit electrons onto the target 27.

With such a configuration, the EUV light generation device 1 can stably supply the target 27 to the plasma generation region 25 at a desired travelling speed even with a simple device configuration to stably generate the EUV light 252.

2. Terms

A "target" is an object to be irradiated with laser light introduced into the chamber. The target irradiated with the laser light is converted into plasma to emit EUV light.

A "droplet" is a mode of the target supplied into the chamber.

An "optical path axis" is an axis passing through the center of the beam cross section of laser light along the travelling direction of the laser light.

An "optical path" is a path on which laser light passes. The optical path may include the optical path axis.

3. Overall Description of EUV Light Generation System

[3.1 Configuration]

FIG. 1 schematically illustrates a configuration of an exemplary LPP EUV light generation system.

The EUV light generation device 1 may be used along with at least one laser device 3. In the present application, a system including the EUV light generation device 1 and the laser device 3 is called an EUV light generation system 11. As illustrated in FIG. 1 and described below in detail, the EUV light generation device 1 may include a chamber 2 and the target supply unit 26. The chamber 2 may be hermetically sealable. The target supply unit 26 may be attached, for example, in such a way as to pass through a wall of the chamber 2. The material of targets 27 supplied from the target supply unit 26 may contain tin, terbium, gadolinium, lithium, xenon, or a combination of two or more of these, not limited to those.

At least one through hole may be provided in the wall of the chamber 2. A window 21 may be provided in the through hole. Pulse laser light 32 output from the laser device 3 may be transmitted through the window 21. An EUV focusing mirror 23, for example, having a reflective surface in a spheroidal shape may be disposed inside the chamber 2. The EUV focusing mirror 23 can have first and second focal points. A multilayer reflective film, for example, having molybdenum and silicon alternately layered may be formed on the surface of the EUV focusing mirror 23. The EUV focusing mirror 23 is preferably disposed, for example, in such a way that its first focal point is positioned in a plasma generation region 25 and its second focal point is positioned at an intermediate focal point (IF) 292. A through hole 24 may be provided in a center part of the EUV focusing mirror 23. Pulse laser light 33 may pass through the through hole 24.

The EUV light generation device 1 may include an EUV light generation controller 5, a target sensor 4 and the like. The target sensor 4 may have an imaging function and may be configured to detect the presence, trajectory, position, speed or the like of the target 27.

Moreover, the EUV light generation device 1 may include a connection part 29 which causes the inside of the chamber 2 and the inside of an exposure device 6 to communicate with each other. A wall 291 in which an aperture 293 is formed may be provided inside the connection part 29. The wall 291 may be disposed in such a way that the aperture 293 is positioned at the second focal point position of the EUV focusing mirror 23.

Furthermore, the EUV light generation device 1 may include a laser light travelling direction controller 34, a laser light focusing mirror 22, a target collector 28 for recovering the targets 27, and the like. The laser light travelling direction controller 34 may include an optical element for defining the travelling direction of laser light, and an actuator for adjusting the position, posture and the like of the optical element.

[3.2 Operation]

Referring to FIG. 1, pulse laser light 31 output from the laser device 3 may pass through the laser light travelling direction controller 34 and be transmitted through the window 21 as the pulse laser light 32 to enter the chamber 2. The pulse laser light 32 may travel inside the chamber 2 along at least one laser light path and be reflected by the laser light focusing mirror 22 to be radiated on at least one target 27 as the pulse laser light 33.

The target supply unit 26 may be configured to output the target 27 toward the plasma generation region 25 inside the chamber 2. The target 27 may be irradiated with at least one pulse contained in the pulse laser light 33. The target 27 irradiated with the pulse laser light 33 can be converted into plasma. From the plasma. EUV light 251 can be emitted along with emissions of light with other wavelengths. The EUV light 251 may be selectively reflected by the EUV focusing mirror 23. The EUV light 252 reflected by the EUV focusing mirror 23 may be focused at the intermediate focal point 292 to be output to the exposure device 6. One target 27 may be irradiated with a plurality of pulses contained in the pulse laser light 33.

The EUV light generation controller 5 may be configured to integrate control of the whole EUV light generation system 11. The EUV light generation controller 5 may be configured to process image data or the like of the target 27 imaged by the target sensor 4. The EUV light generation controller 5 may perform at least one, for example, of timing control to output the targets 27 and control of the output direction or the like of the targets 27. The EUV light generation controller 5 may perform at least one, for example, of control of output timing of the laser device 3, control of the travelling direction of the pulse laser light 32, and control of the focusing position of the pulse laser light 33. The aforementioned various kinds of control are merely exemplary and other control may be added as needed.

4. EUV Light Generation Device Including Charge Neutralizer

[4.1 Configuration]

Figure 2:
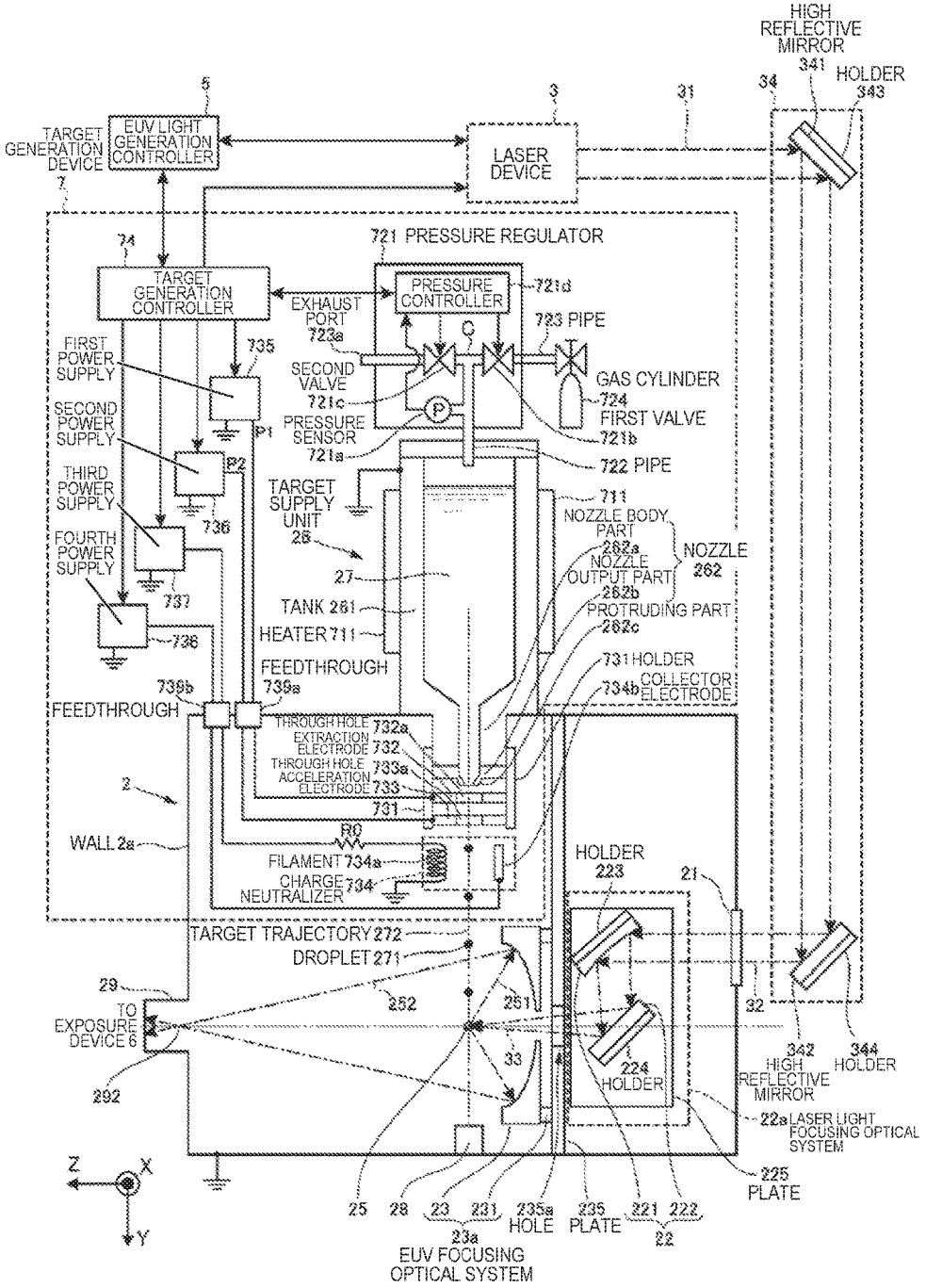
FIG. 2 illustrates a diagram for explaining a configuration of an EUV light generation device including a charge neutralizer.

A configuration of the EUV light generation device 1 that includes a charge neutralizer 734 is described using FIG. 2.

FIG. 2 illustrates a diagram for explaining a configuration of the EUV light generation device 1 including the charge neutralizer 734.

In FIG. 2, a direction along a trajectory 272 of the targets 27 is set as the Y-axis direction. A direction which is perpendicular to the Y-axis direction and in which the EUV light 252 is output from the chamber 2 of the EUV light generation device 1 toward the exposure device 6 is set as the Z-axis direction. The X-axis direction is set to be the direction perpendicular to the Y-axis direction and the Z-axis direction. These coordination axes in FIG. 2 are also the same as in the succeeding figures.

The chamber 2 of the EUV light generation device 1 may be a laser chamber in which the target 27 supplied inside is irradiated with the pulse laser light 33, and thereby, the EUV light 252 is generated as mentioned above.

The chamber 2 may be formed, for example, into a hollow spherical or cylindrical shape. The center axis of the cylindrical chamber 2 may substantially coincide with the direction of outputting the EUV light 252 to the exposure device 6.

A wall 2*a* forming the internal space of the chamber 2 may be formed using a conductive material.

The wall 2*a* forming the internal space of the chamber 2 may be earthed to the ground. The ground potential of the ground may be 0 V.

A laser light focusing optical system 22*a*, an EUV focusing optical system 23*a*, the target collector 28, a plate 225 and a plate 235 may be provided inside the chamber 2.

The laser light travelling direction controller 34, the EUV light generation controller 5 and a target generation device 7 may be provided outside the chamber 2.

The plate 235 may be fixed onto the inner lateral surface of the chamber 2.

At the center of the plate 235, a hole 235*a* through which the pulse laser light 33 can pass in its thickness direction may be provided. The opening direction of the hole 235*a* may be substantially the same direction as that of the axis passing through the through hole 24 and the plasma generation region 25 in FIG. 1.

The EUV focusing optical system 23*a* may be provided on one face of the plate 235.

The plate 225 may be provided on the other face of the plate 235.

The EUV focusing optical system 23*a* provided on the one face of the plate 235 may include the EUV focusing mirror 23 and a holder 231.

The holder 231 may hold the EUV focusing mirror 23.

The holder 231 holding the EUV focusing mirror 23 may be fixed to the plate 235.

The plate 225 provided on the other face of the plate 235 may be changeable in its position and posture by a not-illustrated triaxial stage.

The triaxial stage may include actuators which move the plate 225 in the three axis directions of the X-axis direction, the Y-axis direction and the Z-axis direction. The actuators of the triaxial stage may move the plate 225 based on control of the EUV light generation controller 5. Thereby, the position and the posture of the plate 225 may be changed.

The laser light focusing optical system 22*a* may be provided on the plate 225.

The laser light focusing optical system 22*a* may include the laser light focusing mirror 22, a holder 223 and a holder 224.

The laser light focusing mirror 22 may be disposed such that the pulse laser light 32 having being transmitted through the window 21 provided in the bottom face part of the chamber 2 enters the laser light focusing mirror 22.

The laser light focusing mirror 22 may include an off-axis parabolic mirror 221 and a planar mirror 222.

The holder 223 may hold the off-axis parabolic mirror 221.

The holder 223 holding the off-axis parabolic mirror 221 may be fixed to the plate 225.

The holder 224 may hold the planar mirror 222.

The holder 224 holding the planar mirror 222 may be fixed to the plate 225.

The off-axis parabolic mirror 221 may be disposed to oppose the window 21 provided in the bottom face part of the chamber 2 and the planar mirror 222.

The planar mirror 222 may be disposed to oppose the hole 235*a* and the off-axis parabolic mirror 221.

The positions and the postures of the off-axis parabolic mirror 221 and the planar mirror 222 can be adjusted with the EUV light generation controller 5 changing the position and the posture of the plate 225 by means of the triaxial stage. The adjustment can be performed such that the pulse laser light 33 which is emitted light from the laser light focusing mirror 22 is focused in the plasma generation region 25.

The target collector 28 may be disposed on the extended line of the direction in which the targets 27 output into the chamber 2 travel.

The laser light travelling direction controller 34 may be provided between the window 21 provided in the bottom face part of the chamber 2 and the laser device 3.

The laser light travelling direction controller 34 may be disposed such that the pulse laser light 31 output from the laser device 3 enters the laser light travelling direction controller 34.

The laser light travelling direction controller 34 may include a high reflective mirror 341, a high reflective mirror 342, a holder 343 and a holder 344.

The holder 343 may hold the high reflective mirror 341.

The holder 344 may hold the high reflective mirror 342.

The holder 343 and the holder 344 may be changeable in their positions and postures by a not-illustrated actuator connected to the EUV light generation controller 5.

The high reflective mirror 341 may be disposed to oppose an emission port, of the laser device 3, through which the pulse laser light 31 is emitted and the high reflective mirror 342.

The high reflective mirror 342 may be disposed to oppose the window 21 of the chamber 2 and the high reflective mirror 341.

The positions and the postures of the high reflective mirror 341 and the high reflective mirror 342 can be adjusted with the positions and the postures of the holder 343 and the holder 344 changed based on control of the EUV light generation controller 5. The adjustment can be performed such that the pulse laser light 32 which is emitted light from the laser light travelling direction controller 34 is transmitted through the window 21 provided in the bottom face part of the chamber 2.

The EUV light generation controller 5 may send and receive various signals to/from a not-illustrated exposure device controller provided in the exposure device 6.

For example, to the EUV light generation controller 5, an EUV light output instruction signal which is a signal indicating a control instruction regarding the EUV light 252 output to the exposure device 6 may be sent from the exposure device controller. In the EUV light output instruction signal, various target values such as targeted output start timing, a targeted repetition frequency and targeted pulse energy of the EUV light 252 may be contained.

The EUV light generation controller 5 may integrally control operation of the constituents of the EUV light generation system 11 base on the various signals sent from the exposure device controller.

The EUV light generation controller 5 may send and receive control signals to/from the laser device 3. For example, the EUV light generation controller 5 may output, to the laser device 3, a trigger signal for triggering output of the pulse laser light 31. Thereby, the EUV light generation controller 5 may control operation, of the laser device 3, regarding the output of the pulse laser light 31. The laser device 3 may be a $CO_2$ laser device.

The EUV light generation controller 5 may send and receive control signals to/from the actuators moving the laser light travelling direction controller 34 and the laser light focusing optical system 22*a*. Thereby, the EUV light generation controller 5 may adjust the travelling directions and the focusing position of the pulse laser lights 31 to 33.

The EUV light generation controller 5 may send and receive control signals to/from a target generation controller 74 included in the target generation device 7. Thereby, the EUV light generation controller 5 may indirectly control operation of the constituents included in the target generation device 7.

A hardware configuration of the EUV light generation controller 5 will be described later using FIG. 7.

The target generation device 7 may be a device which generates and supplies the targets 27 supplied into the chamber 2 to the plasma generation region 25 in the chamber 2. The target generation device 7 may be a device which supplies the targets 27 by a so-called electrostatic extraction method.

The material of the targets 27 supplied by the target generation device 7 may be a metal material. The metal material composing the targets 27 may be a material containing tin, terbium, gadolinium, lithium, or a combination of two or more of these. The metal material composing the targets 27 may be preferably tin.

The target generation device 7 may be provided on the lateral face part of the chamber 2.

The target generation device 7 may include the target supply unit 26, a heater 711, a pressure regulator 721, pipes 722 and 723, and a gas cylinder 724. The target generation device 7 may further include a holder 731, an extraction electrode 732, an acceleration electrode 733, the charge neutralizer 734, first to fourth power supplies 735 to 738, feedthroughs 739*a* and 739*b*, and the target generation controller 74.

The target supply unit 26 may contain the target 27 and output the target 27 as droplets 271 into the chamber 2.

The target supply unit 26 may be fixed to the wall 2*a* in the lateral face part of the chamber 2.

The target supply unit 26 may be earthed to the ground similarly to the chamber 2. The target supply unit 26 can be held to be at the ground potential similar to that of the chamber 2.

The target supply unit 26 may include a tank 261 and a nozzle 262.

The tank 261 may contain the target 27 inside in the state of being melted.

The tank 261 may be formed into a hollow cylindrical shape.

The tank 261 may be formed using a conductive material that hardly reacts with the target 27. When the target 27 is tin, the tank 261 may be formed using molybdenum or tungsten.

The potential of the target 27 contained in the tank 261 can be the ground potential similar to that of the chamber 2.

The nozzle 262 may output the target 27 contained in the tank 261 into the chamber 2.

The nozzle 262 may be provided in a bottom face part of the cylindrical tank 261.

The nozzle 262 may be disposed inside the chamber 2 through a hole in the wall 2*a* of the chamber 2. The hole in the wall 2*a* can be closed by installing the target supply unit 26. Thereby, the interior of the chamber 2 can be isolated from the atmosphere.

The nozzle 262 may be formed using a conductive material that hardly reacts with the target 27. The nozzle 262 may be formed using a material similar to that of the tank 261.

The nozzle 262 may include a nozzle body part 262*a* and a nozzle output part 262*b*.

The nozzle body part 262*a* may be formed into a hollow substantial cylindrical shape.

One end of the nozzle body part 262*a* may be fixed to the bottom face part of the tank 261 on the chamber 2 side. The nozzle body part 262*a* may be integrally formed with the tank 261.

To the other end of the nozzle body part 262*a*, the nozzle output part 262*b* may be fixed.

The tank 261 on the one end side of the nozzle body part 262*a* may be positioned outside the chamber 2. The nozzle output part 262*b* on the other end side of the nozzle body part 262*a* may be positioned inside the chamber 2.

The center axis of the nozzle body part 262*a* may substantially coincide with the target trajectory 272 which is a travelling path of the target 27 output into the chamber 2. The plasma generation region 25 inside the chamber 2 may be positioned on the extended line of the center axis of the nozzle body part 262*a*.

The nozzle output part 262*b* may be formed into a substantial disc shape. A through hole through which the target 27 passes may be formed in a center portion of the substantially disc-shaped nozzle output part 262*b*.

The through hole formed in the nozzle output part 262*b* may be formed in such a way that the center axis of the through hole substantially coincides with the center axis of the nozzle body part 262*a*.

A protruding part 262*c* may be formed on the through hole formed in the nozzle output part 262*b*.

The protruding part 262*c* may be formed into a hollow substantial truncated conical shape.

The protruding part 262*c* may be formed in such a way that the tip thereof protrudes toward the plasma generation region 25 side with the opening peripheral edge, on the plasma generation region 25 side, of the through hole formed in the nozzle output part 262*b* being the base end.

A nozzle hole which opens toward the plasma generation region 25 side may be formed at the tip portion of the protruding part 262*c*. The diameter of the nozzle hole may be, for example, 3 μm to 15 μm.

When the pressure in the tank 261 reaches the targeted pressure, the target 27 in the tank 261 can protrude from the nozzle hole of the nozzle output part 262*b*. In this stage, the potential of the target 27 protruding from the nozzle hole of the nozzle output part 262*b* can be the ground potential similar to those of the chamber 2 and the target supply unit 26.

The heater 711 may heat the tank 261.

The heater 711 may be fixed to the outside lateral face part of the cylindrical tank 261.

The heater 711 may be connected to a not-illustrated heater power supply. The heater power supply may be connected to the target generation controller 74. The heater power supply may supply electric power to the heater 711 based on control of the target generation controller 74.

The heater 711 may heat the tank 261 such that the temperature in the tank 261 is held to be a temperature not less than the melting point of the target 27. When the target 27 is tin, the heater 711 may heat the tank 261 such that the temperature in the tank 261 is held to be 260° C. to 290° C.

The pipe 722 may join the tank 261 and the pressure regulator 721.

The pipe 722 may be formed so as to extend from the bottom face part opposite to the nozzle 262 of the tank 261 to the pressure regulator 721.

The end part of the pipe 722 on the pressure regulator 721 side may be joined to the pipe 723 inside the pressure regulator 721. A portion in which the pipe 722 and the pipe 723 are joined is also called a connecting point C.

The pipe 722 may be covered with a not-illustrated heat insulating material or the like. A not-illustrated heater may be installed on the pipe 722. The temperature in the pipe 722 may be held to be the same temperature as the temperature in the tank 261.

The pipe 723 may join the gas cylinder 724 and the pressure regulator 721.

The pipe 723 may be formed so as to extend from the gas cylinder 724 to the outside of the pressure regulator 721 via the inside of the pressure regulator 721. An exhaust port 723*a* may be provided at the tip of the pipe 723 extending to the outside of the pressure regulator 721.

A not-illustrated exhaust pump may be joined to the exhaust port 723*a*. The exhaust pump may be connected to a pressure controller 721*d*.

The pipe 723 may be provided with a heater, a heat insulating material and the like similarly to the pipe 722 and be maintained to have the same temperature as the temperature in the tank 261.

The gas cylinder 724 may be filled with inert gas such as helium or argon.

The gas cylinder 724 may supply the inert gas into the tank 261 via the pressure regulator 721.

The pressure regulator 721 may regulate the pressure in the tank 261 by increasing and decreasing the gas pressure of the inert gas supplied into the tank 261.

The pressure regulator 721 may communicate with the inside of the tank 261 via the pipe 722. The pressure regulator 721 may communicate with the gas cylinder 724 via the pipe 723.

The pressure regulator 721 may include a pressure sensor 721*a*, a first valve 721*b*, a second valve 721*c* and the pressure controller 721*d* other than parts of the pipes 722 and 723 extending inside.

The pressure sensor 721*a* may detect the pressure in the tank 261 connected via the pipe 722.

The pressure sensor 721*a* may be provided on the pipe 722 between the connecting point C in the pressure regulator 721 and the tank 261.

The pressure sensor 721*a* may be connected to the pressure controller 721*d*. The pressure sensor 721*a* may output a detection signal of a detected pressure to the pressure controller 721*d*.

The first valve 721*b* may be provided on the pipe 723 between the connecting point C in the pressure regulator 721 and the gas cylinder 724.

The second valve 721*c* may be provided on the pipe 723 between the connecting point C in the pressure regulator 721 and the exhaust port 723*a*.

The first and second valves 721*b* and 721*c* may be electromagnetically driven valves. The first and second valves 721*b* and 721*c* may be, for example, solenoid valves.

The first and second valves 721*b* and 721*c* may be connected to the pressure controller 721*d*. Opening and closing operation of the first and second valves 721*b* and 721*c* may be controlled by the pressure controller 721*d*.

The pressure controller 721*d* may be connected to the target generation controller 74. To the pressure controller 721*d*, a control signal containing a value of the targeted pressure in the tank 261 may be input from the target generation controller 74.

To the pressure controller 721*d*, a detection signal of the pressure in the tank 261 may be input from the pressure sensor 721*a*.

The pressure controller 721*d* may control opening and closing operation of each of the first and second valves 721*b* and 721*c* such that the pressure detection value indicated by the input detection signal comes close to the value of the input targeted pressure. Thereby, the pressure controller 721*d* can regulate the pressure in the tank 261 to be the targeted pressure by supplying the gas into the tank 261 or exhausting the gas in the tank 261.

The holder 731 may hold the extraction electrode 732 and the acceleration electrode 733.

The holder 731 may be formed using an electrically insulative material.

The holder 731 may be formed into a hollow substantial cylindrical shape whose bottom face is opened.

The center axis of the holder 731 may substantially coincide with the center axis of the nozzle body part 262*a*.

The inner circumferential lateral face of the holder 731 on its one end side may be fixed onto the outer circumferential lateral face of the nozzle body part 262*a*. The other end side of the holder 731 may open toward the plasma generation region 25.

Onto the inner circumferential lateral face of the holder 731, the nozzle output part 262*b*, the extraction electrode 732 and the acceleration electrode 733 may be fixed spaced from one another. The nozzle output part 262*b*, the extraction electrode 732 and the acceleration electrode 733 can be electrically insulated from one another.

On the inner circumferential lateral face of the holder 731, a plurality of not-illustrated grooves may be formed. The grooves can elongate creepage distances between the nozzle output part 262*b*, the extraction electrode 732 and the acceleration electrode 733. Thereby, the grooves can suppress discharging between the nozzle output part 262*b*, the extraction electrode 732 and the acceleration electrode 733.

The extraction electrode 732 may be an electrode configured to generate electrostatic force which extracts the target 27 from the nozzle output part 262*b* into the chamber 2.

The extraction electrode 732 may be provided on the target trajectory 272.

The extraction electrode 732 may be disposed to oppose the protruding part 262*c* spaced from the protruding part 262*c* of the nozzle output part 262*b*.

The extraction electrode 732 may be formed into a substantial disc shape. A through hole 732*a* may be formed in the center portion of the substantially disc-shaped extraction electrode 732. The through hole 732*a* may be a hole which causes the targets 27 output as droplets 271 from the nozzle output part 262*b* to pass therethrough. The center axis of the through hole 732*a* may substantially coincide with the target trajectory 272.

The extraction electrode 732 may be connected to the first power supply 735 via the feedthrough 739*a* provided in the wall 2*a* of the chamber 2. A negative first potential may be applied to the extraction electrode 732 by the first power supply 735.

The extraction electrode 732 to which the negative first potential is applied can generate a potential difference between the extraction electrode 732 and the target 27 at the ground potential protruding from the nozzle hole of the nozzle output part 262*b*. The potential difference can generate electrostatic force between the extraction electrode 732 and the target 27.

Thereby, the target 27 can be extracted from the nozzle hole of the nozzle output part 262*b* to form the droplet 271, which can pass through the through hole 732*a* of the extraction electrode 732. In this stage, the droplet 271 may be positively charged.

The acceleration electrode 733 may be an electrode configured to generate electrostatic force which accelerates the droplet 271 which is the target 27 extracted by the extraction electrode 732. Specifically, the acceleration electrode 733 may be an electrode configured to accelerate the droplet 271 by applying the electrostatic force to the droplet 271 having passed through the through hole 732*a* of the extraction electrode 732.

The acceleration electrode 733 may be disposed to oppose the face of the extraction electrode 732 on the plasma generation region 25 side. The acceleration electrode 733 may be provided on the target trajectory 272 spaced from the extraction electrode 732.

The acceleration electrode 733 may be formed into a substantial disc shape. A through hole 733*a* may be formed at the center portion of the substantially disc-shaped acceleration electrode 733. The through hole 733*a* may be a hole which causes the droplet 271 having passed through the through hole 732*a* of the extraction electrode 732 to pass therethrough. The center axis of the through hole 733*a* may substantially coincide with the target trajectory 272.

The acceleration electrode 733 may be connected to the second power supply 736 via the feedthrough 739*a* provided in the wall 2*a* of the chamber 2. A negative second potential may be applied to the acceleration electrode 733 by the second power supply 736. The negative second potential may be a potential lower than the negative first potential applied to the extraction electrode 732 by the first power supply 735.

The acceleration electrode 733 to which the negative second potential is applied can generate a potential difference between the acceleration electrode 733 and the droplet 271 having passed through the through hole 732*a* of the extraction electrode 732 in the state of being positively charged. The potential difference can generate electrostatic force between the acceleration electrode 733 and the droplet 271.

Thereby, the droplet 271 can be accelerated in the state of being positively charged and can pass through the through hole 733*a* of the acceleration electrode 733. The droplet 271 having passed through the through hole 733*a* can enter the charge neutralizer 734 in the state of being positively charged.

The charge neutralizer 734 may be a device configured to set the droplet 271 entering in the state of being positively charged to be electrically neutral.

The charge neutralizer 734 may be disposed to oppose the face of the acceleration electrode 733 on the plasma generation region 25 side. The charge neutralizer 734 may be provided on the target trajectory 272 spaced from the acceleration electrode 733.

The charge neutralizer 734 may include a filament 734*a* and a collector electrode 734*b*.

The filament 734*a* and the collector electrode 734*b* may be disposed to oppose each other, interposing the target trajectory 272.

The filament 734*a* may be a coil-shaped metal wire formed using tungsten or the like.

One end of the filament 734*a* may be earthed.

The other end of the filament 734*a* may be connected to a resistor RO which restricts a current amount flowing through the filament 734*a*. The resistor RO connected to the other end of the filament 734*a* may be connected to the third power supply 737 via the feedthrough 739*b* provided in the wall 2*a* of the chamber 2. A current may be supplied to the filament 734*a* by the third power supply 737.

The filament 734*a* to which the current is supplied can emit thermoelectrons toward the target trajectory 272.

The collector electrode 734*b* may be an electrode configured to collect the thermoelectrons emitted from the filament 734*a*.

The collector electrode 734*b* may be connected to the fourth power supply 738 via the feedthrough 739*b*. A positive predetermined potential may be applied to the collector electrode 734*b* by the fourth power supply 738.

The collector electrode 734*b* to which the positive predetermined potential is applied can attract and collect the thermoelectrons emitted from the filament 734*a* with electrostatic force. Thereby, the thermoelectrons can flow between the filament 734*a* and the collector electrode 734*b*.

The first power supply 735 may apply the negative first potential to the extraction electrode 732. The negative first potential may be a potential lower than the ground potential of the ground to which the chamber 2 and the target supply unit 26 are earthed.

The output terminal of the first power supply 735 may be connected to the extraction electrode 732. The reference potential terminal of the first power supply 735 may be earthed to the ground.

The first power supply 735 may be connected to the target generation controller 74. The first power supply 735 may apply the first potential to the extraction electrode 732 based on control of the target generation controller 74.

The second power supply 736 may apply the negative second potential to the acceleration electrode 733. The negative second potential may be a potential lower than the negative first potential.

The output terminal of the second power supply 736 may be connected to the acceleration electrode 733. The reference potential terminal of the second power supply 736 may be earthed to the ground.

The second power supply 736 may be connected to the target generation controller 74. The second power supply 736 may apply the second potential to the acceleration electrode 733 based on control of the target generation controller 74.

The third power supply 737 may supply a current to the filament 734*a* of the charge neutralizer 734.

The output terminal of the third power supply 737 may be connected to the filament 734*a* of the charge neutralizer 734 via the resistor RO. The reference potential terminal of the third power supply 737 may be earthed to the ground.

The third power supply 737 may be connected to the target generation controller 74. The third power supply 737 may supply the current to the filament 734*a* based on control of the target generation controller 74.

The fourth power supply 738 may apply a positive predetermined potential to the collector electrode 734*b* of the charge neutralizer 734.

The output terminal of the fourth power supply 738 may be connected to the collector electrode 734*b* of the charge neutralizer 734. The reference potential terminal of the fourth power supply 738 may be earthed to the ground.

The fourth power supply 738 may be connected to the target generation controller 74. The fourth power supply 738 may apply the positive predetermined potential to the collector electrode 734*b* based on control of the target generation controller 74.

The target generation controller 74 may send and receive various signals to/from the EUV light generation controller 5.

For example, to the target generation controller 74, a target output signal which is a signal indicating a control instruction regarding output of the droplet 271 into the chamber 2 may be input from the EUV light generation controller 5. The target output signal may be a signal for controlling operation of the target generation device 7 such that the droplet 271 is output in accordance with various target values contained in the EUV light output instruction signal.

The target generation controller 74 may control operation of the constituents included in the target generation device 7 based on the various signals from the EUV light generation controller 5.

The target generation controller 74 may control operation of the heater 711 such that the temperature in the tank 261 becomes a predetermined targeted temperature, by outputting a control signal to the power supply connected to the heater 711.

The target generation controller 74 may control operation of the pressure regulator 721 such that the pressure in the tank 261 becomes a predetermined targeted pressure, by outputting a control signal to the pressure controller 721*d*.

The target generation controller 74 may control operation of the first power supply 735 such that the negative first potential is applied to the extraction electrode 732, by outputting a control signal to the first power supply 735.

The target generation controller 74 may control operation of the second power supply 736 such that the negative second potential is applied to the acceleration electrode 733, by outputting a control signal to the second power supply 736.

The target generation controller 74 may control operation of the third power supply 737 such that a current is supplied to the filament 734*a*, by outputting a control signal to the third power supply 737.

The target generation controller 74 may control operation of the fourth power supply 738 such that a positive predetermined potential is applied to the collector electrode 734*b*, by outputting a control signal to the fourth power supply 738.

A hardware configuration of the target generation controller 74 will be described later using FIG. 7.

[4.2 Operation]

An overview of operation, regarding target generation, of the EUV light generation device 1 that includes the charge neutralizer 734 is described.

The target generation controller 74 may determine whether or not the target output signal is input from the EUV light generation controller 5.

Upon input of the target output signal, the target generation controller 74 may perform the following processing until a target output stop signal is input from the EUV light generation controller 5.

The target output stop signal may be a signal indicating a control instruction for stopping output of the droplets 271 into the chamber 2.

The target generation controller 74 may control heating operation of the heater 711 such that the temperature in the tank 261 becomes a predetermined targeted temperature, by outputting a control signal to the power supply connected to the heater 711. The predetermined targeted temperature may be a temperature within a predetermined range not less than the melting point of the target 27. When the target 27 is tin, the predetermined targeted temperature may be a temperature of 260° C. to 290° C.

The target generation controller 74 may continuously control the operation of the heater 711 such that the temperature in the tank 261 is maintained to be within the predetermined range not less than the melting point of the target 27.

The target generation controller 74 may control operation of the first power supply 735 such that the negative first potential is applied to the extraction electrode 732, by outputting a control signal to the first power supply 735.

The target generation controller 74 may control operation of the second power supply 736 such that the negative second potential is applied to the acceleration electrode 733, by outputting a control signal to the second power supply 736.

A negative potential gradient can be formed from the nozzle output part 262*b*, from which the target 27 is output, toward the acceleration electrode 733 on the target trajectory 272 from the nozzle output part 262*b* to the acceleration electrode 733.

The target generation controller 74 may control operation of the third power supply 737 such that a current is supplied to the filament 734*a*, by outputting a control signal to the third power supply 737.

The target generation controller 74 may control operation of the fourth power supply 738 such that a positive predetermined potential is applied to the collector electrode 734*b*, by outputting a control signal to the fourth power supply 738.

Thermoelectrons can be emitted from the filament 734*a* to travel toward the collector electrode 734*b*.

The target generation controller 74 may control operation of the pressure regulator 721 such that the pressure in the tank 261 becomes a predetermined targeted pressure, by outputting a control signal to the pressure controller 721*d* of the pressure regulator 721. The predetermined targeted pressure may be a pressure at which the target 27 can protrude from the nozzle hole of the nozzle output part 262*b*, and can separate from the nozzle hole due to the electrostatic force based on the potential difference between the target 27 and the extraction electrode 732 to form the droplet 271. In other words, the predetermined targeted pressure may be a pressure at which the target 27 on which the electrostatic force is exerted can be output as the droplet 271 from the nozzle output part 262*b*.

When the pressure in the tank 261 reaches the predetermined targeted pressure, the target 27 in the tank 261 can protrude from the nozzle hole of the nozzle output part 262*b* to such an extent as not to drop.

In this stage, the potential of the target 27 protruding from the nozzle hole of the nozzle output part 262*b* can be the ground potential.

On the target 27 protruding from the nozzle hole of the nozzle output part 262*b*, a potential difference between the target 27 and the extraction electrode 732 to which the negative first potential is applied can arise. Electrostatic force generated by the potential difference can act on the relevant target 27.

The nozzle hole, of the nozzle output part 262*b*, from which the target 27 is output may be provided in the protruding part 262*c* protruding to the extraction electrode 732 side. Since an electric field tends to focus on the protruding part 262*c*, larger electrostatic force can act on the target 27 protruding from the nozzle hole provided in the protruding part 262*c*.

The target 27 can be attracted to the extraction electrode 732 side with such electrostatic force, and before long, can separate from the nozzle output part 262*b*.

The target 27 having separated can form a free interface due to its own surface tension to form the droplet 271. In this stage, the droplet 271 may be positively charged. The relevant droplet 271 can travel on the target trajectory 272 and pass through the through hole 732*a* in the state of being positively charged.

The droplet 271 having passed through the through hole 732*a* of the extraction electrode 732 in the state of being positively charged can come close to the acceleration electrode 733.

On the droplet 271 coming close to the acceleration electrode 733, a potential difference between the droplet 271 and the acceleration electrode 733 to which the negative second potential is applied can arise. Electrostatic force generated by the potential difference can act on the droplet 271.

The droplet 271 can be attracted to the acceleration electrode 733 side with the electrostatic force to be accelerated. The droplet 271 can travel on the target trajectory 272 and pass through the through hole 733*a* in the state of being positively charged.

The droplet 271 having passed through the through hole 733*a* of the acceleration electrode 733 in the state of being positively charged can enter the charge neutralizer 734.

The droplet 271 having entered the charge neutralizer 734 can be irradiated with thermoelectrons during passing between the filament 734*a* and the collector electrode 734*b* to become electrically neutral.

The electrically neutral droplet 271 can pass through the charge neutralizer 734 to be supplied to the plasma generation region 25. Thermoelectrons not contributing the neutralization of the droplet 271 may be collected on the collector electrode 734*b*.

The EUV light generation controller 5 may control operation of the laser device 3 such that the droplet 271 reaching the plasma generation region 25 is irradiated with the pulse laser light 31, by outputting a trigger signal to the laser device 3.

Upon input of the trigger signal, the laser device 3 can output the pulse laser light 31. The pulse laser light 31 output from the laser device 3 can be introduced as the pulse laser light 32 into the chamber 2 via the laser light travelling direction controller 34. The pulse laser light 32 introduced into the chamber 2 can be focused by the laser light focusing optical system 22*a* to be introduced as the pulse laser light 33 to the plasma generation region 25. The pulse laser light 33 can be introduced to the plasma generation region 25, synchronized with timing of the droplet 271 supplied to the plasma generation region 25. The droplet 271 supplied to the plasma generation region 25 can be irradiated with the pulse laser light 33 introduced to the plasma generation region 25. The droplet 271 irradiated with the pulse laser light 33 can be converted into plasma, which can emit light containing the EUV light 251. The EUV light 251 can be selectively reflected by the EUV focusing mirror 23 and focused as the EUV light 252 at the intermediate focal point 292 to be introduced to the exposure device 6.

5. Problem

As mentioned above, the droplet 271 can pass through the through hole 733*a* of the acceleration electrode 733 in the state of being positively charged, and can enter the charge neutralizer 734. The droplet 271 entering the charge neutralizer 734 can be irradiated with thermoelectrons during passing between the filament 734*a* and the collector electrode 734*b* of the charge neutralizer 734 to become electrically neutral.

To irradiate the droplet 271 with thermoelectrons, the charge neutralizer 734 can include the filament 734*a* whose one end is earthed and the collector electrode 734*b* to which the positive predetermined potential is applied. Namely, there can exist inside the charge neutralizer 734 a potential gradient between the collector electrode 734*b* to which the positive predetermined potential is applied and the filament 734*a* whose one end is earthed. Further, the droplet 271, entering the charge neutralizer 734, before sufficiently irradiated with thermoelectrons can be in the state of being positively charged. In this stage, the droplet 271, entering the charge neutralizer 734, before sufficiently irradiated with thermoelectrons and the collector electrode 734*b* can have electrically the same polarity. Therefore, repulsive force can arise between the droplet 271, entering the charge neutralizer 734, before sufficiently irradiated with thermoelectrons and the collector electrode 734*b*. Accordingly, as to the droplet 271 entering the charge neutralizer 734, there are possibilities of its travelling speed decreasing due to the repulsive force and of deviating off the desired target trajectory 272 due to the same.

Moreover, the droplet 271 can travel, deviating off the region of irradiation with thermoelectrons in the charge neutralizer 734 due to the repulsive force. In this case, the droplet 271 can pass through the charge neutralizer 734, not sufficiently neutralized but charged. Therefore, repulsive force can arise between the charged droplet 271 and ions generated from plasma of the preceding droplet 271 or between the charged droplet 271 and the succeeding charged droplet 271. Accordingly, as to the droplet 271 having passed through the charge neutralizer 734, there are possibilities of its travelling speed decreasing due to the repulsive force and of further deviating from the desired target trajectory 272 until reaching the plasma generation region 25 due to the same.

As a result, there is a possibility that the EUV light generation device 1 that includes the charge neutralizer 734 cannot stably supply the droplets 271 to the plasma generation region 25 at a desired travelling speed and cannot stably generate the EUV light 252.

Therefore, there is desired a technology which can stably generate the EUV light 252 by stably supplying the droplets 271 entering the charge neutralizer 734 to the plasma generation region 25 at a desired travelling speed.

6. Target Generation Device Included in EUV Light Generation Device of First Embodiment The target generation device 7 that is included in the EUV light generation device 1 of a first embodiment is described using FIG. 3 to FIG. 5.

The target generation device 7 included in the EUV light generation device 1 of the first embodiment may be mainly different from the target generation device 7 illustrated in FIG. 2 in configuration corresponding to the holder 731, the extraction electrode 732, the acceleration electrode 733 and the charge neutralizer 734.

For the configuration of the EUV light generation device 1 of the first embodiment, description of the similar configuration to that of the EUV light generation device 1 illustrated in FIG. 2 is omitted.

[6.1 Configuration]

Figure 3:
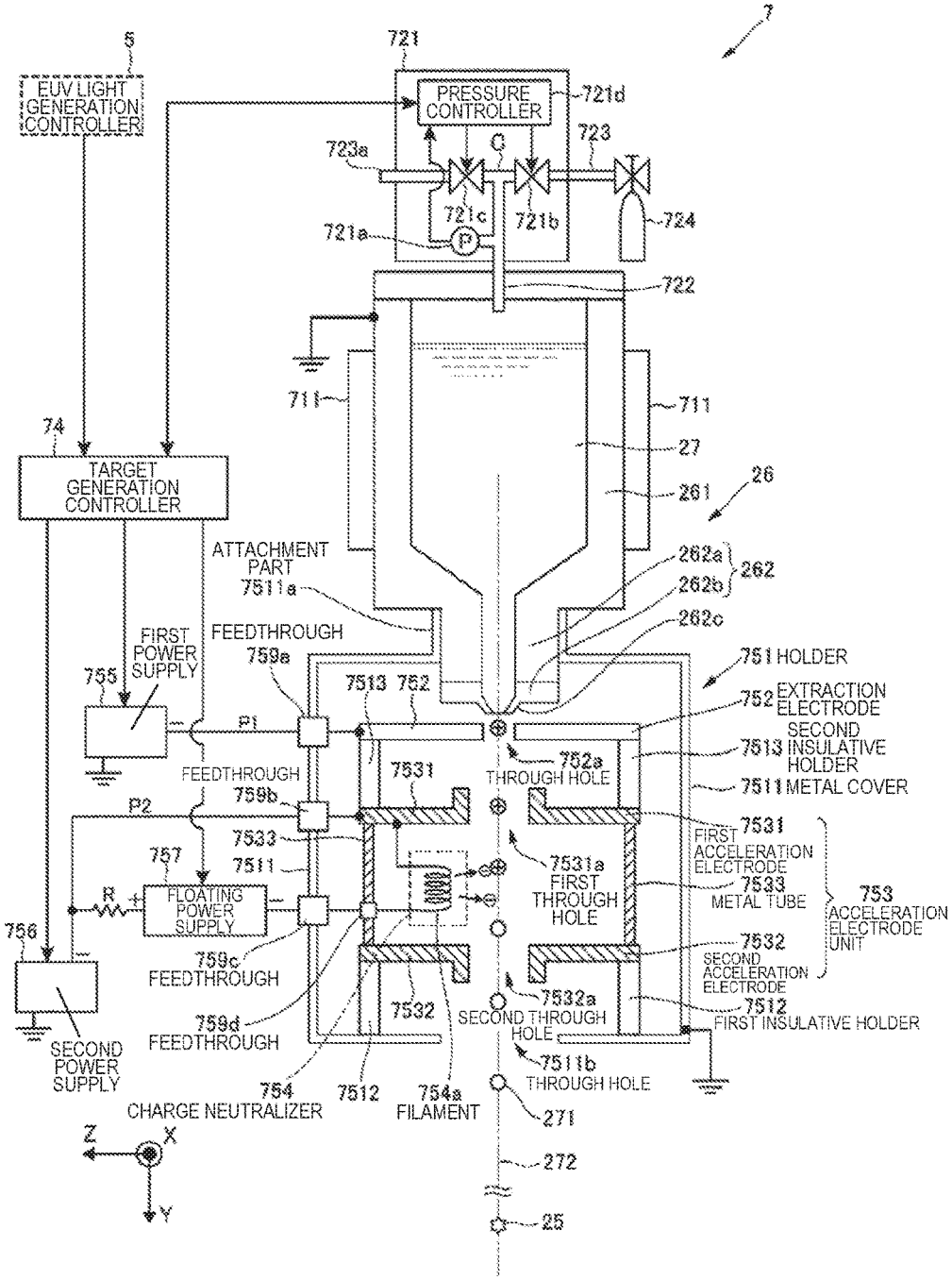
FIG. 3 illustrates a diagram for explaining a configuration of a target generation device included in an EUV light generation device of a first embodiment.

A configuration of the target generation device 7 included in the EUV light generation device 1 of the first embodiment is described using FIG. 3.

FIG. 3 illustrates a diagram for explaining the configuration of the target generation device 7 included in the EUV light generation device 1 of the first embodiment.

The target generation device 7 in FIG. 3 may include the target supply unit 26, the heater 711, the pressure regulator 721, the pipes 722 and 723, and the gas cylinder 724. These constituents may be similar to those of the target generation device 7 illustrated in FIG. 2.

The target generation device 7 in FIG. 3 may further include a holder 751, the extraction electrode 752, the acceleration electrode unit 753, the charge neutralizer 754, the first and second power supplies 755 and 756, a floating power supply 757, feedthroughs 759*a* to 759*d*, and the target generation controller 74.

The holder 751 may hold the extraction electrode 752, the acceleration electrode unit 753 and the charge neutralizer 754.

The holder 751 may include a metal cover 7511, a first insulative holder 7512 and a second insulative holder 7513.

The metal cover 7511 may contain the extraction electrode 752, the acceleration electrode unit 753 and the charge neutralizer 754 inside.

The metal cover 7511 may be formed into a hollow substantial cylindrical shape.

An attachment part 7511*a* may be provided at the center of the bottom face part of the metal cover 7511 on its one end side.

The attachment part 7511*a* may be formed into a hollow substantial cylindrical shape. The attachment part 7511*a* may be formed in such a way that with the vicinity of the center of the bottom face part of the metal cover 7511 on the one end side being the base end, the tip thereof extends to the target supply unit 26 along the center axis direction of the metal cover 7511. The inner circumferential lateral face of the attachment part 7511*a* on its tip side may be fixed to the outer circumferential lateral face of the nozzle body part 262*a*.

A through hole 7511*b* may be provided at the center of the bottom face part of the metal cover 7511 on the other end side. The through hole 7511*b* may open toward the plasma generation region 25 and cause the droplets 271 to pass therethrough.

The center axis of the metal cover 7511 may substantially coincide with the center axis of the nozzle body part 262*a*.

The metal cover 7511 may be earthed to the ground similarly to the chamber 2 and the target supply unit 26. The potential of the metal cover 7511 can be the ground potential similarly to those of the chamber 2 and the target supply unit 26.

The first insulative holder 7512 may hold the acceleration electrode unit 753 so as to contain it in the metal cover 7511.

The first insulative holder 7512 may be formed into a hollow substantial cylindrical shape whose bottom face is opened.

The first insulative holder 7512 may be disposed inside the metal cover 7511.

The outer circumferential lateral face of the first insulative holder 7512 may be separated from the inner circumferential lateral face of the metal cover 7511.

The center axis of the first insulative holder 7512 may substantially coincide with the center axis of the metal cover 7511.

One end face of the first insulative holder 7512 may be fixed to the inner surface of the bottom face part, of the metal cover 7511, in which the through hole 7511*b* is formed.

Onto the other end face of the first insulative holder 7512, the outer surface of the acceleration electrode unit 753 on the plasma generation region 25 side may be fixed.

The first insulative holder 7512 may be formed using an electrically insulative material and can insulate the metal cover 7511 from the acceleration electrode unit 753.

The second insulative holder 7513 may hold the extraction electrode 752 so as to contain it in the metal cover 7511.

The second insulative holder 7513 may be formed into a hollow substantial cylindrical shape whose bottom face is opened. The outer diameter of the second insulative holder 7513 may be substantially the same of the outer diameter of the first insulative holder 7512.

The second insulative holder 7513 may be disposed inside the metal cover 7511.

The outer circumferential lateral face of the second insulative holder 7513 may be separated from the inner circumferential lateral face of the metal cover 7511.

The center axis of the second insulative holder 7513 may substantially coincide with the center axis of the metal cover 7511.

One end face of the second insulative holder 7513 may be fixed to the surface, on the target supply unit 26 side, of the acceleration electrode unit 753 fixed to the first insulative holder 7512.

Onto the other end face of the second insulative holder 7513, the outer surface of the extraction electrode 752 on the plasma generation region 25 side may be fixed.

The second insulative holder 7513 may be formed using an electrically insulative material and can insulate the extraction electrode 752 from the acceleration electrode unit 753. The second insulative holder 7513 can insulate the metal cover 7511 from the extraction electrode 752.

The extraction electrode 752 may be configured similarly to the extraction electrode 732 illustrated in FIG. 2.

Namely, the extraction electrode 752 may be disposed on the target trajectory 272 spaced from the protruding part 262*c* of the nozzle output part 262*b* to oppose the relevant protruding part 262*c*.

The extraction electrode 752 may be formed into a substantial disc shape. In its center portion, a through hole 752*a* similar to the through hole 732*a* illustrated in FIG. 2 may be formed.

The outer diameter of the extraction electrode 752 may be substantially the same as the outer diameter of the second insulative holder 7513.

The extraction electrode 752 may be connected to the first power supply 755 via the feedthrough 759*a* provided in the metal cover 7511 and a not-illustrated feedthrough provided in the wall 2*a* of the chamber 2. A negative first potential P1 may be applied to the extraction electrode 752 by the first power supply 755.

The extraction electrode 752 to which the negative first potential P1 is applied can generate a potential difference between the extraction electrode 752 and the target 27 which has the ground potential and protrudes from the nozzle hole of the nozzle output part 262*b*. The potential difference can generate electrostatic force between the extraction electrode 752 and the target 27.

Thereby, the target 27 can be extracted from the nozzle hole of the nozzle output part 262*b* to form the droplet 271, which can pass through the through hole 752*a* of the extraction electrode 752. In this stage, the droplet 271 may be positively charged.

The acceleration electrode unit 753 may be a member configured to accelerate the droplet 271 which is the target 27 extracted by the extraction electrode 752. Specifically, it may be a member configured to accelerate the droplet 271 passing through the through hole 752*a* of the extraction electrode 752.

The acceleration electrode unit 753 may be provided on the target trajectory 272.

The acceleration electrode unit 753 may be formed into a hollow substantial cylindrical shape. The outer diameter of the acceleration electrode unit 753 may be substantially the same as the outer diameters of the first insulative holder 7512 and the second insulative holder 7513.

The center axis of the acceleration electrode unit 753 may substantially coincide with the target trajectory 272.

The charge neutralizer 754 may be disposed inside the acceleration electrode unit 753.

The acceleration electrode unit 753 may include a first acceleration electrode 7531, a second acceleration electrode 7532 and a metal tube 7533.

The first acceleration electrode 7531 may be disposed to oppose the face of the extraction electrode 752 on the plasma generation region 25 side.

The first acceleration electrode 7531 may be provided spaced from the extraction electrode 752 by the second insulative holder 7513 interposed between the first acceleration electrode 7531 and the extraction electrode 752.

The first acceleration electrode 7531 may constitute the bottom face plate, on the extraction electrode 752 side, of the acceleration electrode unit 753 formed into a substantial cylindrical shape.

The first acceleration electrode 7531 may be formed into a substantial cylindrical shape. A first through hole 7531*a* may be formed in the center portion of the substantially cylindrically shaped first acceleration electrode 7531. The first through hole 7531*a* may be a hole configured to introduce the droplet 271 having passed through the through hole 752*a* of the extraction electrode 752 inside the acceleration electrode unit 753. The center axis of the first through hole 7531*a* may substantially coincide with the target trajectory 272.

The first acceleration electrode 7531 may be connected to the second power supply 756 via the feedthrough 759*b* provided in the metal cover 7511 and a not-illustrated feedthrough provided in the wall 2*a* of the chamber 2. A negative second potential P2 may be applied to the first acceleration electrode 7531 by the second power supply 756. The negative second potential P2 may be a potential sufficiently lower than the negative first potential P1 applied to the extraction electrode 752 by the first power supply 755.

The first acceleration electrode 7531 to which the negative second potential P2 is applied can generate a potential difference between the first acceleration electrode 7531 and the droplet 271 having passed through the through hole 752*a* of the extraction electrode 752 in the state of being positively charged. The potential difference can generate electrostatic force between the first acceleration electrode 7531 and the droplet 271.

Thereby, the droplet 271 can be accelerated in the state of being positively charged and enter the first through hole 7531*a* of the first acceleration electrode 7531. The droplet 271 entering the first through hole 7531*a* can be introduced inside the acceleration electrode unit 753 in the state of being positively charged.

The metal tube 7533 may join the first acceleration electrode 7531 and the second acceleration electrode 7532.

The metal tube 7533 may constitute the lateral face part of the acceleration electrode unit 753 formed into a substantial cylindrical shape.

The metal tube 7533 may be formed into a hollow substantial cylindrical shape whose bottom face is opened.

The end face of the metal tube 7533 on the first acceleration electrode 7531 side may be joined to the first acceleration electrode 7531 by welding or soldering. The end face of the metal tube 7533 on the second acceleration electrode 7532 side may be joined to the second acceleration electrode 7532 by welding or soldering.

The center axis of the metal tube 7533 may substantially coincide with the target trajectory 272.

Since the metal tube 7533 may be joined to the first acceleration electrode 7531, it may have substantially the same potential as that of the first acceleration electrode 7531. When the negative second potential P2 is applied to the first acceleration electrode 7531, the negative second potential P2 may be applied also to the metal tube 7533.

Therefore, a potential difference can hardly arise between the first acceleration electrode 7531 and the metal tube 7533.

The second acceleration electrode 7532 may be disposed to oppose the through hole 7511*b* of the metal cover 7511. The second acceleration electrode 7532 may be provided spaced from the through hole 7511*b* by the first insulative holder 7512 interposed between the second acceleration electrode 7532 and the bottom face part, of the metal cover 7511, in which the through hole 7511*b* is formed.

The second acceleration electrode 7532 may constitute the bottom face plate, on the through hole 7511*b* side, of the substantially cylindrically formed acceleration electrode unit 753.

The second acceleration electrode 7532 may be formed into a substantial disc shape. A second through hole 7532*a* may be formed in the center portion of the substantially disc-shaped second acceleration electrode 7532. The second through hole 7532*a* may be a hole configured to lead, outside the acceleration electrode unit 753, the droplet 271 introduced inside the acceleration electrode unit 753 from the first through hole 7531*a* of the first acceleration electrode 7531. The center axis of the second through hole 7532*a* may substantially coincide with the target trajectory 272.

The second acceleration electrode 7532 may be connected to the first acceleration electrode 7531 via the metal tube 7533. The second acceleration electrode 7532 may have substantially the same potential as those of the first acceleration electrode 7531 and the metal tube 7533. When the negative second potential P2 is applied to the first acceleration electrode 7531, the negative second potential P2 may be applied also to the second acceleration electrode 7532.

Therefore, potential differences can hardly arise between the first acceleration electrode 7531, the metal tube 7533 and the second acceleration electrode 7532. Accordingly, the space enclosed by the first acceleration electrode 7531, the metal tube 7533 and the second acceleration electrode 7532 can be a space with substantially the same potential and with almost no potential gradient.

The charge neutralizer 754 may be disposed inside the acceleration electrode unit 753.

The charge neutralizer 754 may be a device which causes the droplet 271 introduced inside the acceleration electrode unit 753 in the state of being positively charged to be electrically neutral.

The charge neutralizer 754 may include a filament 754*a*.

The filament 754*a* may be a coil-shaped metal wire formed using tungsten or the like.

The filament 754*a* may be disposed to oppose the inner circumferential lateral face of the metal tube 7533, interposing the target trajectory 272 between these.

One end of the filament 754*a* may be connected to at least one of the first acceleration electrode 7531 and the second acceleration electrode 7532. The one end of the filament 754*a* illustrated in FIG. 3 may be connected to the first acceleration electrode 7531.

The other end of the filament 754*a* may be connected to the floating power supply 757 via the feedthrough 759*d*, the feedthrough 759*c*, and a not-illustrated feedthrough provided in the wall 2*a* of the chamber 2. A current may be supplied to the filament 754*a* by the floating power supply 757.

The filament 754*a* to which the current is supplied can emit thermoelectrons toward the target trajectory 272. The thermoelectrons can diffuse inside the acceleration electrode unit 753.

The first power supply 755 may apply the negative first potential P1 to the extraction electrode 752. The negative first potential P1 may be a potential sufficiently lower than the ground potential of the ground to which the chamber 2 and the target supply unit 26 are earthed. The measurement of the negative first potential P1 may be, for example, several kV.

The output terminal of the first power supply 755 may be connected to the extraction electrode 752. The reference potential terminal of the first power supply 755 may be earthed to the ground.

The first power supply 755 may be connected to the target generation controller 74. The first power supply 755 may apply the first potential P1 to the extraction electrode 752 based on control of the target generation controller 74.

The second power supply 756 may apply the negative second potential P2 to the acceleration electrode unit 753. Specifically, the second power supply 756 may apply the negative second potential P2 to the first acceleration electrode 7531 of the acceleration electrode unit 753. The negative second potential P2 may be a potential sufficiently lower than the negative first potential P1 applied to the extraction electrode 752 by the first power supply 755. The measurement of the negative second potential P2 may be, for example, several tens of kV.

The output terminal of the second power supply 756 may be connected to any member of the acceleration electrode unit 753. FIG. 3 illustrates an example in which the output terminal of the second power supply 756 is connected to the first acceleration electrode 7531. The reference potential terminal of the second power supply 756 may be earthed to the ground.

The second power supply 756 may be connected to the target generation controller 74. The second power supply 756 may apply the second potential P2 to the first acceleration electrode 7531 based on control of the target generation controller 74.

The floating power supply 757 may supply a current to the filament 754*a* of the charge neutralizer 754.

The output terminal of the floating power supply 757 on the negative side may be connected to one end of the filament 754*a* of the charge neutralizer 754 via a not-illustrated feedthrough provided in the wall 2*a* of the chamber 2, the feedthrough 759*c* and the feedthrough 759*d*. The other end of the filament 754*a* may be connected to the first acceleration electrode 7531 to which the negative second potential P2 is supplied by the second power supply 756.

The output terminal of the floating power supply 757 on the positive side may be connected to a connection cable between the second power supply 756 and the first acceleration electrode 7531 via a resistor R.

The output voltage of the floating power supply 757 may be exceedingly small relative to the potential difference between the negative second potential P2 applied to the first acceleration electrode 7531 by the second power supply 756 and the ground potential. The output voltage of the floating power supply 757 may be, for example, several V to several tens of V.

Thereby, the floating power supply 757 can generate the relevant output voltage with the negative second potential P2 being as a reference, and can supply, to the filament 754*a*, a current defined by the output voltage and the relevant resistance R. As a result, the target generation device 7 can take a simple configuration in which a weak current is sufficient to be supplied to the filament 754*a* to such an extent that the filament 754*a* can emit thermoelectrons. In addition, the target generation device 7 can generate only a slight potential gradient due to the filament 754*a* in the space inside the acceleration electrode unit 753. The target generation device 7 can make the space in the acceleration electrode unit 753 a space with substantially the same potential and with almost no potential gradient.

The floating power supply 757 may be connected to the target generation controller 74. The floating power supply 757 may supply a current to the filament 754*a* based on control of the target generation controller 74.

The target generation controller 74 may control operation of the first power supply 755 such that the negative first potential P1 is applied to the extraction electrode 752, by outputting a control signal to the first power supply 755.

The target generation controller 74 may control operation of the second power supply 756 such that the negative second potential P2 is applied to the first acceleration electrode 7531, by outputting a control signal to the second power supply 756.

The target generation controller 74 may control operation of the floating power supply 757 such that a current is supplied to the filament 754*a*, by outputting a control signal to the floating power supply 757. Thereby, the target generation controller 74 may turn on the charge neutralizer 754.

The other configuration of the EUV light generation device 1 of the first embodiment including the target generation device 7 may be similar to that of the EUV light generation device 1 illustrated in FIG. 2.

[6.2 Operation]

Figure 4:
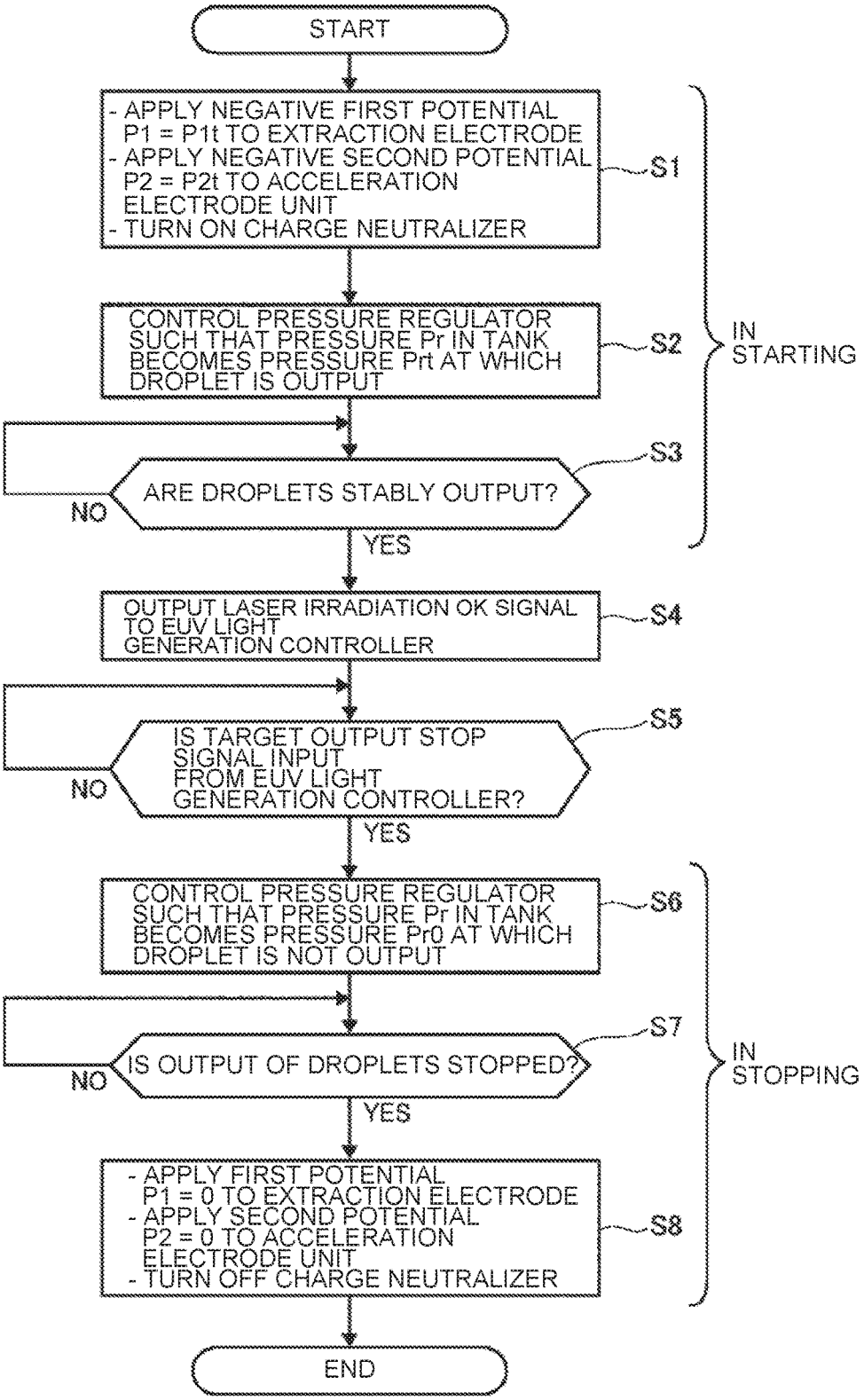
FIG. 4 is a flowchart for explaining an overview of processing regarding target generation in a target generation controller illustrated in FIG. 3.
Figure 5:
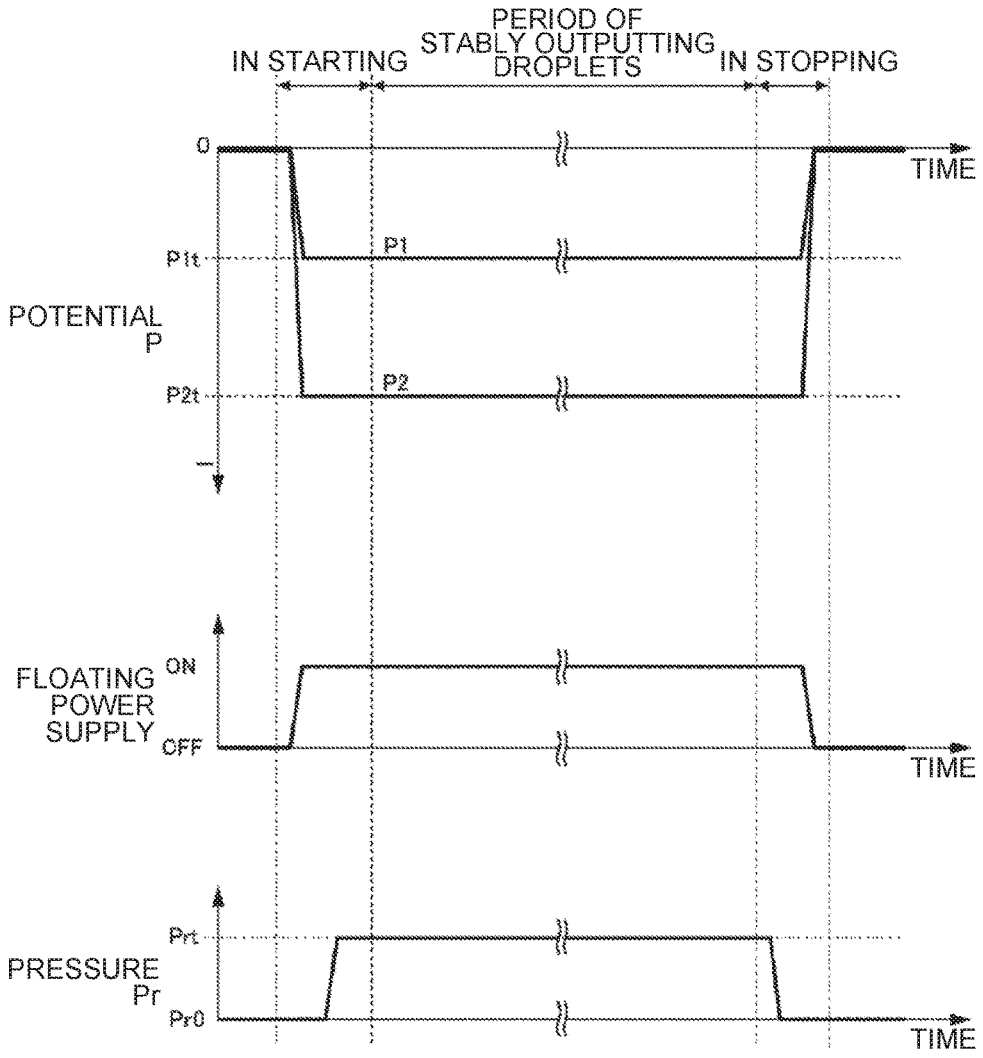
FIG. 5 illustrates a timing chart for explaining relations between transitions of a first potential and a second potential respectively applied to an extraction electrode and an acceleration electrode unit, operation timing of a floating power supply, and a transition of a pressure in a tank.

Operation of the target generation device 7 included in the EUV light generation device 1 of the first embodiment is described using FIG. 4 and FIG. 5.

FIG. 4 illustrates a flowchart for explaining an overview of processing regarding target generation in the target generation controller 74 illustrated in FIG. 3.

For the operation of the EUV light generation device 1 of the first embodiment including the target generation device 7, description of operation similar to that of the EUV light generation device 1 illustrated in FIG. 2 is omitted.

The target generation controller 74 may determine whether or not the target output signal is input from the EUV light generation controller 5.

Upon input of the target output signal, the target generation controller 74 may control operation of the heater 711 such that the temperature in the tank 261 becomes the predetermined targeted temperature similarly to the target generation controller 74 illustrated in FIG. 2.

The metal target 27 contained in the tank 261 can be in the state of being melted.

Subsequently, the target generation controller 74 may perform the following processing as illustrated in FIG. 4.

In step S1, the target generation controller 74 may control operation of the first power supply 755 such that the negative first potential P1 applied to the extraction electrode 752 becomes P1*t*, by outputting a control signal to the first power supply 755.

P1*t* may be the target value of the first potential P1. P1*t* may be the first potential P1 at which the target 27 which is at the ground potential and protrudes from the nozzle hole of the nozzle output part 262*b* can be extracted by the potential difference between the target 27 and the extraction electrode 752 to form the droplet 271.

The extraction electrode 752 can be in the state of P1*t* applied as the negative first potential P1. A negative potential gradient can be formed from the nozzle output part 262*b* toward the extraction electrode 752.

Moreover, the target generation controller 74 may control operation of the second power supply 756 such that the negative second potential P2 applied to the first acceleration electrode 7531 of the acceleration electrode unit 753 becomes P2*t*, by outputting a control signal to the second power supply 756.

P2*t* may be the target value of the second potential P2. P2*t* may be the second potential P2 at which the droplet 271 can be accelerated such that the droplet 271 formed by the extraction electrode 752 is supplied to the plasma generation region 25 at a desired travelling speed. P2*t* may be a potential sufficiently lower than P1*t*.

The first and second acceleration electrodes 7531 and 7532 and the metal tube 7533 can be in the state of P2*t* applied as the negative second potential P2. While a negative potential gradient can be formed from the nozzle output part 262*b* toward the first acceleration electrode 7531, the space in the acceleration electrode unit 753 can be at substantially the same potential.

Furthermore, the target generation controller 74 may turn on the charge neutralizer 754.

Specifically, the target generation controller 74 may turn on the floating power supply 757 such that the current is supplied to the filament 754*a* of the charge neutralizer 754, by outputting a control signal to the floating power supply 757.

A weak current can flow in the filament 754*a* to such an extent that the filament 754*a* can emit thermoelectrons. The filament 754*a* can emit thermoelectrons toward the target trajectory 272 in the acceleration electrode unit 753. The thermoelectrons can diffuse inside the acceleration electrode unit 753 and be collected on the inner wall of the acceleration electrode unit 753. A potential distribution in the acceleration electrode unit 753 can be maintained to be at substantially the same potential to such an extent that the influence of the current flowing in the filament 754*a* can be ignored.

In step S2, the target generation controller 74 may control operation of the pressure regulator 721 such that a pressure Pr in the tank 261 becomes a predetermined targeted pressure Prt, by outputting a control signal to the pressure controller 721*d* of the pressure regulator 721.

Prt may be the pressure Pr at which the target 27 can protrude from the nozzle hole of the nozzle output part 262*b* and separate from the nozzle hole due to the electrostatic force based on the potential difference between the target 27 and the extraction electrode 752 to form the droplet 271. In other words, Prt may be the pressure Pr at which the target 27 can be output as the droplet 271 from the nozzle output part 262*b* with the electrostatic force. Furthermore, Prt may be the pressure Pr at which the droplets 271 thus output can be supplied to the plasma generation region 25 to have a desired dimension at a desired output interval.

When the pressure Pr in the tank 261 reaches Prt, the target 27 in the tank 261 can protrude from the nozzle hole of the nozzle output part 262*b*.

In this stage, the potential of the target 27 protruding from the nozzle hole of the nozzle output part 262*b* can be the ground potential.

The target 27 protruding from the nozzle hole of the nozzle output part 262*b* can generate a potential difference between the target 27 and the extraction electrode 752 to which P1*t* is applied as the negative first potential P1. Electrostatic force generated by the potential difference can act on the target 27.

The target 27 can be attracted to the extraction electrode 752 side with the electrostatic force, and before long, can separate from the nozzle output part 262*b*.

The target 27 having separated can form a free interface due to its own surface tension to form the droplet 271. In this stage, the droplet 271 may be positively charged. The relevant droplet 271 can travel on the target trajectory 272 and pass through the through hole 752*a* in the state of being positively charged.

The droplet 271 having passed through the through hole 752*a* of the extraction electrode 752 in the state of being positively charged can come close to the first acceleration electrode 7531.

The droplet 271 coming close to the first acceleration electrode 7531 can generate a potential difference between the droplet 271 and the first acceleration electrode 7531 to which P2*t* is applied as the negative second potential P2. Electrostatic force generated by the potential difference can act on the droplet 271.

The droplet 271 can be attracted to the first acceleration electrode 7531 side with the electrostatic force to be accelerated, and can enter the first through hole 7531*a* of the first acceleration electrode 7531. The droplet 271 entering the first through hole 7531*a* can pass through the first through hole 7531*a* in the state of being positively charged, and can be introduced inside the acceleration electrode unit 753.

The droplet 271 introduced inside the acceleration electrode unit 753 in the state of being positively charged can travel along the target trajectory 272 in the acceleration electrode unit 753 which is at substantially the same potential. In this stage, the droplet 271 can be irradiated with thermoelectrons emitted from the filament 754*a* of the charge neutralizer 754 to be electrically neutral.

The electrically neutral droplet 271 can enter the second through hole 7532*a* of the second acceleration electrode 7532. The droplet 271 entering the second through hole 7532*a* can be accelerated at a sufficient speed to pass through the second through hole 7532*a*, still being electrically neutral, and can be led outside the acceleration electrode unit 753.

The droplet 271 having been led outside the acceleration electrode unit 753 can pass through the through hole 7511*b* of the metal cover 7511 in the state of being electrically neutral, and can travel on the target trajectory 272 to be supplied to the plasma generation region 25.

In step S3, the target generation controller 74 may determine whether or not the droplets 271 are stably output.

After performing control such that the pressure Pr in the tank 261 becomes the predetermined targeted pressure Prt in step S2, the target generation controller 74 may determine whether or not the droplets 271 are stably output with elapse of a predetermined time being as a determination condition. Otherwise, the target generation controller 74 may determine whether or not the droplets 271 are stably output with stability of the travelling speed or the output interval of the droplets 271 which are image-measured by the target sensor 4 being as a determination condition.

When the droplets 271 are not stably output, the target generation controller 74 may maintain the state to stand by until they are stably output. Meanwhile, when the droplets 271 are stably output, the target generation controller 74 may put the process forward to step S4.

In step S4, the target generation controller 74 may output a laser irradiation OK signal to the EUV light generation controller 5. Still after outputting the laser irradiation OK signal, the target generation controller 74 may continue control of the constituents in the target generation device 7 to output the droplets 271.

The laser irradiation OK signal may be a signal for notifying that the droplets 271 supplied to the plasma generation region 25 can be irradiated with the pulse laser light 33 since the droplets 271 are stably output.

Upon input of the laser irradiation OK signal, the EUV light generation controller 5 can output the pulse laser light 31 from the laser device 3 by outputting the trigger signal to the laser device 3. The pulse laser light 31 output from the laser device 3 can be introduced as the pulse laser light 33 into the plasma generation region 25 as mentioned above to be radiated on the droplets 271. The droplets 271 irradiated with the pulse laser light 33 can be converted into plasma, which can emit light containing the EUV light 251. The EUV light 251 can be selectively reflected by the EUV focusing mirror 23 and focused as the EUV light 252 at the intermediate focal point 292 to be led to the exposure device 6.

In step S5, the target generation controller 74 may determine whether or not the target output stop signal is input from the EUV light generation controller 5.

When the target output stop signal is not input, the target generation controller 74 may continue output of the droplets 271 until it is input. Meanwhile, when the target output stop signal is input, the target generation controller 74 may put the process forward to step S6.

In step S6, the target generation controller 74 may control operation of the pressure regulator 721 such that the pressure Pr in the tank 261 becomes a predetermined pressure Pr0, by outputting a control signal to the pressure controller 721*d* of the pressure regulator 721.

Pr0 may be a pressure Pr to such an extent that the target 27 does not protrude from the nozzle hole of the nozzle output part 262*b*. In other words, Pr0 may be a pressure Pr at which the droplet 271 is not output with the electrostatic force. The value of Pr0 may be an initial value of the pressure Pr in the tank 261.

The droplets 271 being stably output can stop their own output before long.

In step S7, the target generation controller 74 may determine whether or not output of the droplets 271 is stopped.

The target generation controller 74 may determine whether or not output of the droplets 271 is stopped with elapse of a predetermined time after control to cause the pressure Pr in the tank 261 to become the predetermined pressure Pr0 in step S6 being as a determination condition. Otherwise, the target generation controller 74 may determine whether or not output of the droplets 271 with no measurement of droplets 271 which are image-measured by the target sensor 4 being as a determination condition.

When output of the droplets 271 is not stopped, the target generation controller 74 may stand by until stopped. Meanwhile, when output of the droplets 271 is stopped, the target generation controller 74 may put the process forward to step S8.

In step S8, the target generation controller 74 may control operation of the first power supply 755 such that the negative first potential P1 applied to the extraction electrode 752 becomes 0, by outputting a control signal to the first power supply 755.

The potential of the extraction electrode 752 can be the ground potential which is substantially the same potential as those of the chamber 2 and the target supply unit 26. As mentioned above, the ground potential may be 0 V.

Moreover, the target generation controller 74 may control operation of the second power supply 756 such that the negative second potential P2 applied to the acceleration electrode unit 753 becomes 0, by outputting a control signal to the second power supply 756.

The potential of the acceleration electrode unit 753 can be the ground potential which is substantially the same as those of the chamber 2 and the target supply unit 26.

Furthermore, the target generation controller 74 may turn off the charge neutralizer 754.

Specifically, the target generation controller 74 may turn off the floating power supply 757 such that a current is not supplied to the filament 754*a* of the charge neutralizer 754, by outputting a control signal to the floating power supply 757. After that, the target generation controller 74 may end the processing.

Thermoelectrons emitted from the filament 754*a* can be not to be emitted.

The processing in and before step S3 may be processing performed in starting the target generation device 7. The processing in steps S4 and S5 may be processing performed during a period when the droplets 271 are stably output. The processing in steps S6 to S8 may be processing performed in stopping the target generation device 7.

FIG. 5 illustrates a timing chart for explaining relations between transitions of the first potential P1 and second potential P2 respectively applied to the extraction electrode 752 and the acceleration electrode unit 753, operation timing of the floating power supply 757, and a transition of the pressure Pr in the tank 261.

The relations between these can be the following relations by means of the processing illustrated in FIG. 4.

In starting the target generation device 7, first, the first potential P1 applied to the extraction electrode 752 can fall from 0 V to P1*t*. The second potential P2 applied to the acceleration electrode unit 753 can fall from 0 V to P2*t* substantially simultaneously with the fall of the first potential P1.

The floating power supply 757 can be turned on substantially simultaneously with the time point of starting the falls, from 0 V, of the first potential P1 and the second potential P2 respectively applied to the extraction electrode 752 and the acceleration electrode unit 753.

After the first potential P1 and the second potential P2 respectively applied to the extraction electrode 752 and the acceleration electrode unit 753 and the floating power supply 757 become stable, the pressure Pr in the tank 261 can rise from Pr0 to Prt.

Then, during the period of stably outputting the droplets 271, the first potential P1 and the second potential P2 respectively applied to the extraction electrode 752 and the acceleration electrode unit 753 can be maintained to be P1*t* and P2*t*, respectively.

The floating power supply 757 can also be maintained to be in the state of being turned on.

The pressure Pr in the tank 261 can also be maintained to be Prt.

After that, in stopping the target generation device 7, first, the pressure Pr in the tank 261 can fall from Prt to Pr0.

After the pressure Pr in the tank 261 becomes stable to be Pr0, the first potential P1 applied to the extraction electrode 752 can rise from P1*t* to 0 V. The second potential P2 applied to the acceleration electrode unit 753 can also rise from P2*t* to 0 V substantially simultaneously with the rise of the first potential P1.

The floating power supply 757 can be turned off substantially simultaneously with the time point of starting the respective rises, from P1*t* and P2*t*, of the first potential P1 and the second potential P2 respectively applied to the extraction electrode 752 and the acceleration electrode unit 753.

The other operation of the EUV light generation device 1 of the first embodiment including the target generation device 7 may be similar to that of the EUV light generation device 1 illustrated in FIG. 2.

[6.3 Effect]

With the aforementioned configuration, in the EUV light generation device 1 of the first embodiment, since the target supply unit 26 is earthed to the ground similarly to the chamber 2, the whole target supply unit 26 is sufficient not to be electrically insulated from the chamber 2 by its floating from the chamber 2.

Therefore, the EUV light generation device 1 of the first embodiment can take a simple and compact device configuration without need for complex insulation designing.

Moreover, in the EUV light generation device 1 of the first embodiment, the droplets 271 extracted by the extraction electrode 752 can be positively charged and accelerated by the acceleration electrode unit 753.

Therefore, in the EUV light generation device 1 of the first embodiment, the travelling speed of the droplets 271 can be made high and the EUV light 252 can be output at a high repetition frequency.

Furthermore, in the EUV light generation device 1 of the first embodiment, the charge neutralizer 754 can be disposed inside the acceleration electrode unit 753 and the space in the acceleration electrode unit 753 can be made at substantially the same potential. Further, in the EUV light generation device 1 of the first embodiment, the droplets 271 can be made electrically neutral by the charge neutralizer 754 to be supplied to the plasma generation region 25.

Therefore, the EUV light generation device 1 of the first embodiment can suppress the travelling speed of the droplets 271 from decreasing and the droplets 271 from deviating off the desired target trajectory 272.

As above, the EUV light generation device 1 of the first embodiment can stably supply the droplets 271 to the plasma generation region 25 at a desired travelling speed even with a simple device configuration to stably generate the EUV light 252.

Notably, in the above description, the EUV light generation device 1 of the first embodiment takes a mode in which the negative first potential P1 applied to the extraction electrode 752 is maintained constant to be P1*t* during the period of stably outputting the droplets 271.

Nevertheless, the EUV light generation device 1 of the first embodiment may take a mode in which the droplets 271 can be output on demand during the period of stably outputting the droplets 271 by changing the first potential P1 in a pulse shape between P1*t* and 0 V.

7. Target Generation Device Included in EUV Light Generation Device of Second Embodiment The target generation device 7 that is included in the EUV light generation device 1 of a second embodiment is described using FIG. 6.

Figure 6:
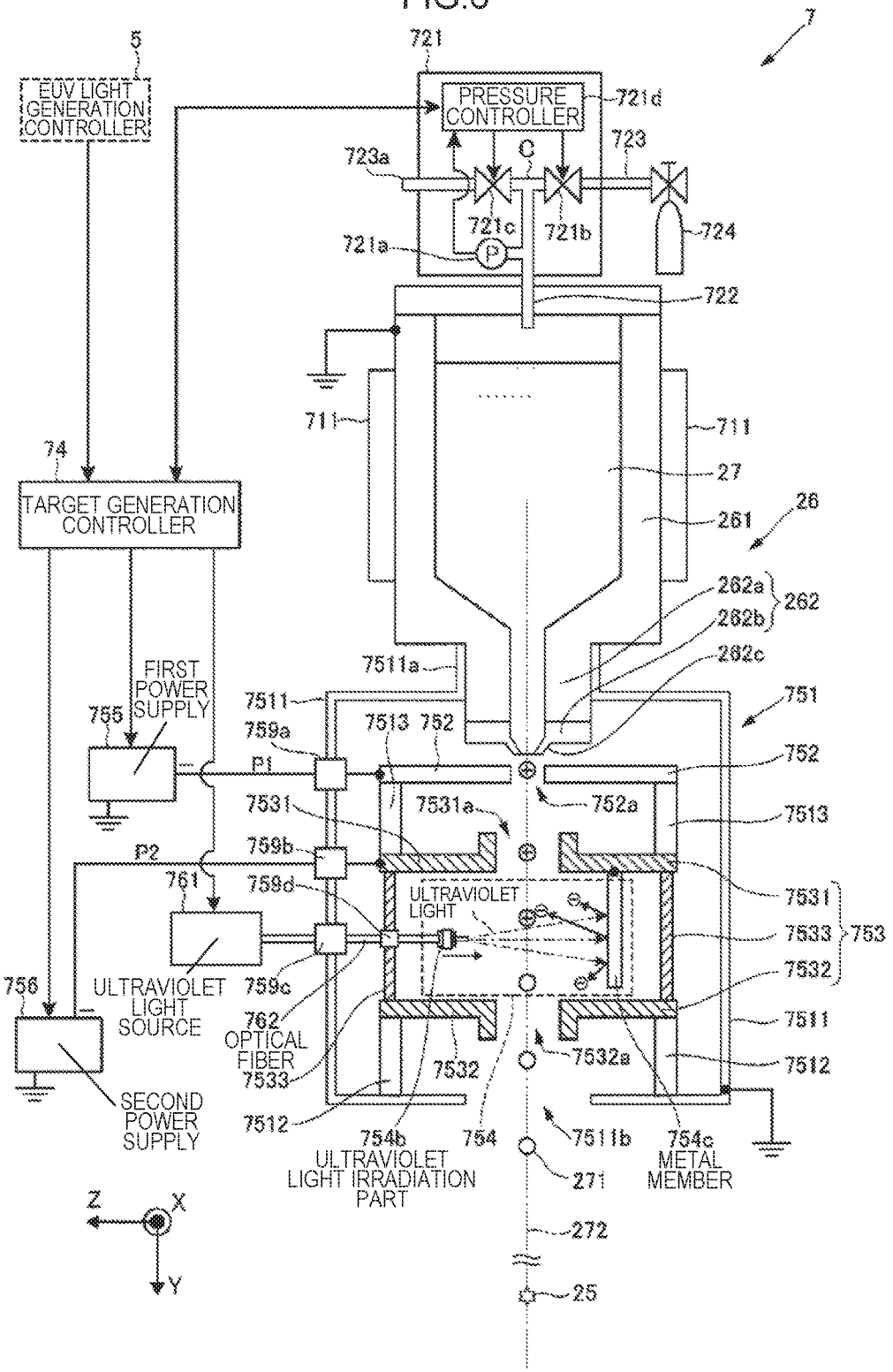
FIG. 6 illustrates a diagram for explaining of a configuration of a target generation device included in an EUV light generation device of a second embodiment.

FIG. 6 illustrates a diagram for explaining a configuration of the target generation device 7 included in the EUV light generation device 1 of the second embodiment.

The target generation device 7 included in the EUV light generation device 1 of the second embodiment may be different from the target generation device 7 included in the EUV light generation device 1 of the first embodiment illustrated in FIG. 3 to FIG. 5 in configuration regarding the charge neutralizer 754.

Specifically, the target generation device 7 according to the second embodiment may include the charge neutralizer 754 that includes an ultraviolet light irradiation part 754*b* and a metal member 754*c* in place of the charge neutralizer 754 that includes the filament 754*a* illustrated in FIG. 3. The target generation device 7 according to the second embodiment may include an ultraviolet light source 761 and an optical fiber 762 in place of the resistor R and the floating power supply 757, and the connection cable between the floating power supply 757 and the filament 754*a* illustrated in FIG. 3.

For the configuration of the EUV light generation device 1 of the second embodiment, description of the similar configuration to that of the EUV light generation device 1 of the first embodiment illustrated in FIG. 3 to FIG. 5 is omitted.

The ultraviolet light source 761 in FIG. 6 may be a light source which outputs ultraviolet light having a wavelength range of 193 nm to 400 nm. The ultraviolet light source 761 may be a laser device, a mercury lamp or a deuterium lamp.

The ultraviolet light source 761 may be connected to the target generation controller 74. The ultraviolet light source 761 may output the ultraviolet light based on control of the target generation controller 74.

The optical fiber 762 in FIG. 6 may be an optical fiber which transmits the ultraviolet light output from the ultraviolet light source 761.

The optical fiber 762 may be composed, for example, using synthesized quartz.

The optical fiber 762 may optically connect the ultraviolet light irradiation part 754*b* included in the charge neutralizer 754 to the ultraviolet light source 761. The optical fiber 762 extending from the ultraviolet light source 761 may be connected to the ultraviolet light irradiation part 754*b* via a not-illustrated feedthrough provided in the wall 2*a* of the chamber 2, the feedthrough 759*c* and the feedthrough 759*d*.

The charge neutralizer 754 in FIG. 6 may be a charge neutralizer using the photoelectric effect.

The charge neutralizer 754 may be disposed inside the acceleration electrode unit 753 similarly to the charge neutralizer 754 illustrated in FIG. 3.

The charge neutralizer 754 may include the ultraviolet light irradiation part 754*b* and the metal member 754*c* as mentioned above.

The ultraviolet light irradiation part 754*b* and the metal member 754*c* may be disposed to oppose each other, interposing the target trajectory 272.

The ultraviolet light irradiation part 754*b* may be provided at the tip of the optical fiber 762 extending from the ultraviolet light source 761.

The ultraviolet light irradiation part 754*b* may be a sleeve configured to irradiate the metal member 754*c* in the acceleration electrode unit 753 with ultraviolet light output from the ultraviolet light source 761.

The metal member 754*c* may include a metal plate configured to emit electrons by means of the photoelectric effect upon irradiation with ultraviolet light by the ultraviolet light irradiation part 754*b*.

The metal plate of the metal member 754*c* may be disposed such that the face irradiated with ultraviolet light is exposed and opposes to the ultraviolet light irradiation part 754*b*.

The metal plate of the metal member 754*c* may be formed using a metal material having a work function not more than the energy of the ultraviolet light radiated by the ultraviolet light irradiation part 754*b*. The metal material may be, for example, platinum (Pt), tungsten (W) or nickel (Ni). When the wavelength of the ultraviolet light radiated by the ultraviolet light irradiation part 754*b* is 303 nm or less, the metal material may be Pt. When the wavelength of the ultraviolet light radiated by the ultraviolet light irradiation part 754*b* is 273 nm or less, the metal material may be W. When the wavelength of the ultraviolet light radiated by the ultraviolet light irradiation part 754*b* is 305 nm or less, the metal material may be Ni.

The metal member 754*c* may be connected to at least one of the first acceleration electrode 7531, the metal tube 7533 and the second acceleration electrode 7532. The metal member 754*c* illustrated in FIG. 6 may be electrically connected to the first acceleration electrode 7531. The metal member 754*c* may have substantially the same potential as that of the first acceleration electrode 7531. When the negative second potential P2 is applied to the first acceleration electrode 7531, the negative second potential P2 may be applied also to the metal member 754*c*.

Therefore, a potential difference can be not to arise between the first acceleration electrode 7531, the second acceleration electrode 7532 and the metal tube 7533, and the metal member 754*c*. Accordingly, the space between the acceleration electrode unit 753 and the metal member 754*c* can be a space with substantially the same potential and with almost no potential gradient.

The target generation controller 74 may control operation of the ultraviolet light source 761 such that the metal member 754*c* is irradiated with ultraviolet light from the ultraviolet light irradiation part 754*b*, by outputting a control signal to the ultraviolet light source 761. Thereby, the target generation controller 74 may turn on the charge neutralizer 754.

Specifically, when turning on the charge neutralizer 754, the target generation controller 74 may cause the ultraviolet light source 761 to output ultraviolet light such that the metal member 754*c* is irradiated with the ultraviolet light from the ultraviolet light irradiation part 754*b*, by outputting a control signal to the ultraviolet light source 761.

The ultraviolet light output from the ultraviolet light source 761 can be emitted from the ultraviolet light irradiation part 754*b* via the optical fiber 762. The metal member 754*c* can be irradiated with the ultraviolet light emitted from the ultraviolet light irradiation part 754*b*. The metal member 754*c* irradiated with the ultraviolet light can emit electrons by means of the photoelectric effect. The electrons can diffuse in the acceleration electrode unit 753. Since the potential of the space in the acceleration electrode unit 753 is substantially the same potential as those of the first acceleration electrode 7531 and the metal member 754*c*, the space can still be a space with substantially the same potential and with almost no potential gradient.

Accordingly, the droplet 271 introduced inside the acceleration electrode unit 753 in the state of being positively charged can be led outside the acceleration electrode unit 753 in the state of being electrically neutral without deviating off the desired target trajectory 272 or being decelerated.

The other configuration and operation of the EUV light generation device 1 of the second embodiment including the target generation device 7 may be similar to those of the EUV light generation device 1 of the first embodiment illustrated in FIG. 3 to FIG. 5.

With the aforementioned configuration, the EUV light generation device 1 of the second embodiment can further reduce the potential gradient inside the charge neutralizer 754 in addition to the effect similar to that of the first embodiment.

Therefore, the EUV light generation device 1 of the second embodiment can further suppress the travelling speed of the droplets 271 from decreasing and the droplets 271 from deviating off the desired target trajectory 272.

As above, the EUV light generation device 1 of the second embodiment can also stably supply the droplets 271 to the plasma generation region 25 at a desired travelling speed even with a simple device configuration to stably generate the EUV light 252.

8. Miscellaneous

[8.1 Hardware Environment for Controllers]

The skilled in the art will understand that the subject matters mentioned here can be implemented by combining program modules or software applications with a general purpose computer or a programmable controller. In general, the program modules contain routines, programs, components, data structures and the like with which the processes described in the present disclosure can be implemented.

Figure 7:
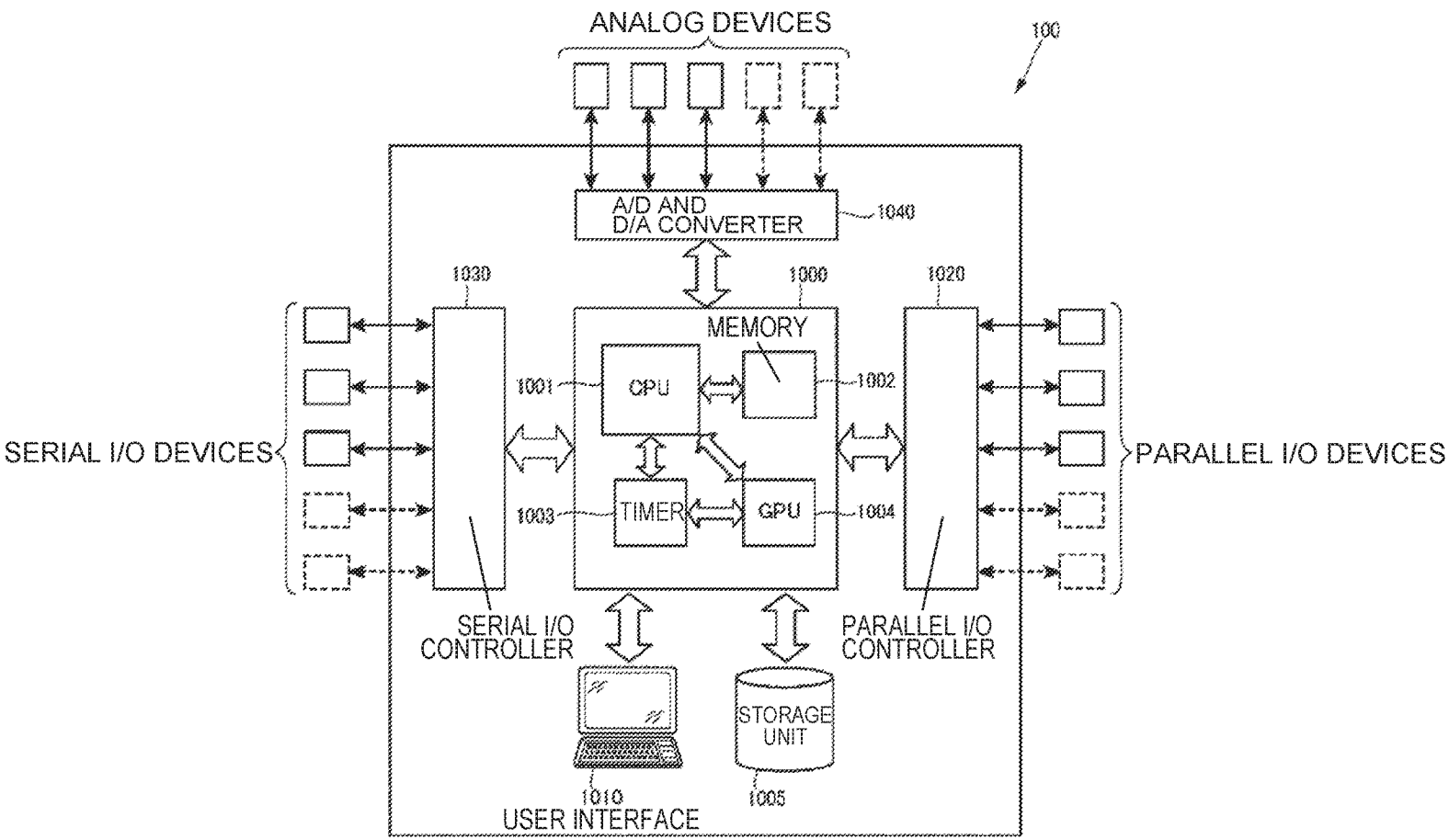
FIG. 7 illustrates a block diagram illustrating a hardware environment for controllers.

FIG. 7 is a block diagram illustrating an exemplary hardware environment with which various aspects of the disclosed subject matters can be implemented. An exemplary hardware environment 100 in FIG. 7 may include a processing unit 1000, a storage unit 1005, a user interface 1010, a parallel I/O controller 1020, a serial I/O controller 1030 and A/D and D/A converter 1040, the configuration of the hardware environment 100 not limited to this.

The processing unit 1000 may include a central processing unit (CPU) 1001, a memory 1002, a timer 1003 and a graphic processing unit (GPU) 1004. The memory 1002 may include a random access memory (RAM) and a read-only memory (ROM). The CPU 1001 may be any of commercially available processors. A dual microprocessor or another multiprocessor architecture may be used as the CPU 1001.

These constituents in FIG. 7 may be connected to one another for implementing the processes described in the present disclosure.

As to their operation, the processing unit 1000 may read and execute programs stored in the storage unit 1005. The processing unit 1000 may also read data from the storage unit 1005 along with the programs. The processing unit 1000 may write data into the storage unit 1005. The CPU 1001 may execute the program read from the storage unit 1005. The memory 1002 may be a working region which temporarily stores the program executed by the CPU 1001 and the data used for the operation of the CPU 1001. The timer 1003 may measure time intervals to output the measurement results to the CPU 1001 in accordance to the execution of the program. The GPU 1004 may process image data to output the processing results to the CPU 1001 in accordance to the program read from the storage unit 1005.

The parallel I/O controller 1020 may be connected to parallel I/O devices which can communicate with the processing unit 1000, such as the exposure device controller, the EUV light generation controller 5, the pressure controller 721*d* and the target generation controller 74, and may control communications between the processing unit 1000 and these parallel I/O devices. The serial I/O controller 1030 may be connected to serial I/O devices which can communicate with the processing unit 1000, such as the laser light travelling direction controller 34, the pressure regulator 721, the first to fourth power supplies 735 to 738, the first and second power supplies 755 and 756, the floating power supply 757 and the ultraviolet light source 761, and may control communications between the processing unit 1000 and these serial I/O devices. The A/D and D/A converter 1040 may be connected to analog devices such as various sensors such as temperature sensors, pressure sensors, vacuum gauges, the target sensor 4 and the pressure sensor 721*a* via analog ports, may control communications between the processing unit 1000 and these analog devices, and may perform A/D and D/A conversion of the contents of the communications.

The user interface 1010 may display, to an operator, the progress of the programs executed by the processing unit 1000 such that the operator can instruct the processing unit 1000 to stop the programs and to execute interrupt routines.

The exemplary hardware environment 100 may be applied to the configuration of the exposure device controller, the EUV light generation controller 5, the pressure controller 721*d*, the target generation controller 74 and the like in the present disclosure. The skilled in the art will understand that these controllers may be implemented on a distributed computing environment, that is, an environment in which the processing unit connected to these via a communication network can execute tasks. In the present disclosure, the exposure device controller, the EUV light generation controller 5, the pressure controller 721*d*, the target generation controller 74 and the like may be connected to one another via communication networks such as the Ethernet and the Internet. In the distributed computing environment, the program modules may be stored in both local and remote memory storage devices.

[8.2 Other Modifications]

The metal tube 7533 may be formed by weaving metal wires into a mesh. Namely, the configuration of the metal tube 7533 is not specially limited as long as the space in the acceleration electrode unit 753 becomes at substantially the same potential.

The EUV light generation controller 5 and the target generation controller 74 may be configured as an integrated controller by combining parts or the entireties of these.

It will be apparent to the skilled in the art that the embodiments described above, including their modifications, can apply their technologies to one another.

The aforementioned description intends mere exemplification, not limitation. Accordingly, it will be apparent to the skilled in the art that modifications of the embodiments of the present disclosure may occur without departing from the spirit of the appended claims.

The terms used throughout the description and the appended claims should be construed to be "non-restrictive". For example, the term such as "include" or "included" should be construed to mean "include, but should not be limited to". The term "have" should be construed to mean "have, but should not be limited to". The modifier "a" in the description and the appended claims should be construed to mean "at least one" or "one or more".

What is claimed is:

1. An extreme ultraviolet light generation device comprising:

a chamber earthed to a ground, in which extreme ultraviolet light is generated by irradiating a metal target supplied inside with laser light;

a target supply unit earthed to the ground, fixed to the chamber and configured to output the target to be supplied into the chamber from a nozzle;

an extraction electrode disposed on a target output side of the nozzle and configured to exert electrostatic force on the target by applying a negative first potential to the extraction electrode;

a first power supply configured to apply the first potential to the extraction electrode;

an acceleration electrode unit disposed at a position through which the target extracted by the extraction electrode passes, and configured to accelerate the target by applying a negative second potential lower than the first potential to the acceleration electrode unit;

a second power supply configured to apply the second potential to the acceleration electrode unit; and a charge neutralizer disposed inside the acceleration electrode unit and configured to emit electrons onto the target.

2. The extreme ultraviolet light generation device according to claim 1, the acceleration electrode unit including:

a first acceleration electrode provided with a first through hole configured to introduce the target extracted by the extraction electrode inside from the first through hole; and a second acceleration electrode provided with a second through hole configured to lead the target introduced from the first through hole outside from the second through hole, wherein the second potential is applied to the first acceleration electrode and the second acceleration electrode, and the charge neutralizer is disposed between the first acceleration electrode and the second acceleration electrode.

3. The extreme ultraviolet light generation device according to claim 2, wherein the charge neutralizer includes a filament, one end of the filament is connected to at least one of the first acceleration electrode and the second acceleration electrode, and the other end of the filament is connected to a floating power supply connected to the second power supply.

4. The extreme ultraviolet light generation device according to claim 2, wherein the charge neutralizer includes:

a metal member connected to at least one of the first acceleration electrode and the second acceleration electrode; and an ultraviolet light irradiation part configured to irradiate the metal member with ultraviolet light.

* * * * *